US012446747B2

(12) United States Patent
Weber

(10) Patent No.: US 12,446,747 B2
(45) Date of Patent: Oct. 21, 2025

(54) VACUUM ATTACHMENT TOOL

(71) Applicant: Dean Weber, Byron Center, MI (US)

(72) Inventor: Dean Weber, Byron Center, MI (US)

(73) Assignee: Dean Weber, Byron Center, MI (US)

( * ) Notice: Subject to any disclaimer, the term of this patent is extended or adjusted under 35 U.S.C. 154(b) by 212 days.

(21) Appl. No.: 18/195,286

(22) Filed: May 9, 2023

(65) Prior Publication Data

US 2023/0355062 A1 Nov. 9, 2023

Related U.S. Application Data

(60) Provisional application No. 63/364,358, filed on May 9, 2022.

(51) Int. Cl.
*A47L 9/02* (2006.01)
*A47L 9/24* (2006.01)

(52) U.S. Cl.
CPC ..... *A47L 9/248* (2013.01); *A47L 9/02* (2013.01); *A47L 9/244* (2013.01)

(58) Field of Classification Search
CPC .... A47L 9/06; A47L 9/068; A47L 9/02–0693; A47L 9/0488; A47L 13/02; A47L 13/022; A47L 13/08; A01K 13/002; E01H 1/0845; B08B 1/165; B26B 19/3846; B26B 19/44
USPC ..... 15/236.01, 236.04, 401
See application file for complete search history.

(56) References Cited

U.S. PATENT DOCUMENTS 4,715,088 A 12/1987 Haase
D303,026 S 8/1989 Kilakis
D375,822 S 11/1996 Lessig, III et al.
5,659,923 A 8/1997 Coombs
6,032,328 A 3/2000 Harmon et al.
D509,332 S 9/2005 White
8,069,531 B2 * 12/2011 Ruston ..... A47L 9/02 15/93.4
D658,832 S 5/2012 Eden et al.
D746,526 S 12/2015 Cole et al.
D760,970 S 7/2016 Ventress et al.
D789,634 S 6/2017 Witter et al.
(Continued)

FOREIGN PATENT DOCUMENTS

DE 102017118896 A1 2/2019

OTHER PUBLICATIONS

WIPO Translation DE102017118896; Cordes, Martin; Attachment for a Vacuum Cleaner Suction Tube; Feb. 21, 2019 (Year: 2019).*
(Continued)

*Primary Examiner* — Tom Rodgers
*Assistant Examiner* — Sidney D Full
(74) *Attorney, Agent, or Firm* — Bodman PLC; Peter A. Cummings

(57) ABSTRACT

The present disclosure provides a vacuum attachment tool configured to be attached to a vacuum hose. The vacuum attachment tool includes a hollow body extending between a first opening configured to be coupled to a vacuum hose and a second opening fluidly coupled with the first opening. The vacuum attachment tool also includes a scrapper portion is disposed on the hollow body and protrudes outward near the second opening. The scrapper portion includes a v-shape that is configured to correspond to a chamfered ground crevice for scraping debris out of the chamfered ground crevice.

11 Claims, 17 Drawing Sheets

(56) References Cited

U.S. PATENT DOCUMENTS

| | | | |
|---|---|---|---|
| D796,135 | S | 8/2017 | Yoon et al. |
| 9,782,048 | B2 | 10/2017 | Witter et al. |
| 10,058,223 | B2 | 8/2018 | Zimmer |
| D854,767 | S | 7/2019 | Bond |
| D863,702 | S | 10/2019 | Wordie et al. |
| 10,791,899 | B2 | 10/2020 | Carter |
| D923,269 | S | 6/2021 | Reed et al. |
| D939,164 | S | 12/2021 | Lee et al. |
| 11,426,043 | B2 * | 8/2022 | Shanafelt ..... A47L 9/02 |
| 2013/0306107 | A1 | 11/2013 | Jensen |
| 2013/0326843 | A1 | 12/2013 | Schwartz |
| 2022/0062954 | A1 | 3/2022 | Soemoto et al. |

OTHER PUBLICATIONS

Cen-Tec 11 in. Commercial Aluminum Crevice Vacuum Tool 67458; https://www.homedepot.com/p/Cen-Tec-11-in-Commercial-Aluminum-Crevice-Vacuum-Tool-67458/312905564; retrieved from the internet Mar. 4, 2022; 9 pp.

Thin Flexible Slim Flat Crevice & Crack Tool Attachment for Vacuum Cleaner 1.25"/ebay; https://www.ebay.com/itm/382852487373; retrieved from the internet Mar. 4, 2022; 4 pp.

* cited by examiner

VACUUM ATTACHMENT TOOL

CROSS-REFERENCE TO RELATED APPLICATION

This application claims benefit and priority under 35 U.S.C § 119(e) to U.S. Provisional Patent Application No. 63/364,358, filed May 9, 2022, the disclosure of which is considered part of this application and is hereby incorporated by reference in its entirety.

TECHNICAL FIELD

The present disclosure relates to a vacuum attachment tool, and more particularly to a tool that attaches to a vacuum hose or suction receptacle for cleaning undesirable material, debris, and the like from crevices and ground surfaces.

BACKGROUND

It is relatively common, especially in warmer climates, for driveways, patios, sidewalks, walk ways and the like to be primarily made with brick pavers, concrete pavers, stone pavers, tiles, concrete formed to imitate pavers or tiles, or other similar surface materials that arrange or appear to arrange multiple objects to make up the surface. However, these brick pavers or other objects have small spaces between them to account for expansion and contraction of the material and drainage. These small spaces easily collect dirt, plant matter, or other debris, which can be unsightly and generally undesirable.

Current examples of solutions to clean debris from these areas include pressure washers and crevice brushes or scrapping tools, which fail to pick up the debris from the surface and often result in a tedious process of trying to avoid moving the debris into other crevices and ultimately having to remove the same debris multiple times from different crevices. Also, some of these cleaning tools, especially pressure washers, can penetrate deep into the crevice and remove jointing sand between the pavers that results in unstable pavers when removed. Accordingly, current approaches fail to adequately address the problems associated with removing dirt and debris from an elongated narrow space such as the space between brick pavers in a driveway or other surface.

SUMMARY

The present disclosure provides a vacuum system and a vacuum attachment tool that removably attaches to a vacuum, such as at an intake end of a vacuum hose that extends from a vacuum appliance. The vacuum attachment tool includes a hollow body with a thin-walled structure that surrounds an interior suction path extending between openings at opposing ends of the hollow body. A scrapper portion is disposed at a distal end or nozzle end of the hollow body and protrudes outward from the interior suction path. The scrapper portion defines a v-shape that is configured to engage a ground crevice, such as a chamfered crevice between brick pavers. In use of the vacuum attachment tool, the scrapper portion is moved in and along the chamfered crevice to remove accumulated debris in the chamfered crevice in a manner that prevents disturbance of substrate between the brick pavers below the chamfered crevice.

In accordance with one aspect of the disclosure, a vacuum attachment tool comprising includes a hollow body with a nozzle end of the hollow body having an intake opening for receiving air and debris. An attachment end of the hollow body is configured to be coupled to a vacuum located remotely from the hollow body that generates an suction air flow from the intake opening through the hollow body. A scrapping member is disposed at the nozzle end of the hollow body and protrudes outward from the intake opening. A protruding edge of the scrapping member has a v-shape that is configured to correspond to a chamfered shape of a crevice for scraping debris from the crevice.

In accordance with another aspect the disclosure, a vacuum attachment tool includes a hollow body having a nozzle end that forms an intake opening and an attachment end for attachment to a vacuum that generates suction of air and debris along an interior suction path from the intake opening through the hollow body. A scrapper portion is disposed at the nozzle end of the hollow body. The scrapper portion includes a protruding edge that defines a v-shape extending radially outward from the interior suction path. The v-shape of the protruding edge is configured to correspond to a chamfered shape of a ground crevice.

In yet another aspect of the disclosure, a vacuum system includes a vacuum appliance, a vacuum hose attached to the vacuum appliance, and a vacuum attachment tool attached to the vacuum hose. The vacuum attachment tool includes a hollow body having an attachment end coupled to the vacuum hose and a nozzle end with an intake opening for receiving air and debris. Air flow that is generated by the vacuum appliance is received from the intake opening through the hollow body and the vacuum hose. A scrapping member is disposed at the nozzle end of the hollow body and protrudes outward from the intake opening. The scrapping member includes a v-shape that is configured to correspond to a chamfered ground crevice for scraping debris out of the ground crevice. In some examples, the vacuum attachment tool or the hose may include a tubular wand extension attached between the attachment end of the hollow body and the flexible section of the vacuum hose, such that tubular wand extension may allow a user to stand while removing debris from the ground crevice.

Implementations of the disclosure may include one or more of the following optional features. In some examples, the scrapping member includes a rigid piece that is a separate piece from the hollow body and that is attached at least partially along a distal edge of the nozzle end of the hollow body. For instance, in some implementations, the scrapping member is a metal blade that defines the v-shape of the protruding edge. Also, in some examples, the scrapping member includes a second portion that protrudes outward from the intake opening and that has a different shape from the v-shape of the protruding edge.

In some examples, the scrapping member includes a planar plate, such as a strip of metal. In such examples, the protruding edge of the scrapping member has a first linear edge and a second linear edge of the planar plate that meet at a point and together define the v-shape. The v-shape may form an angle that is configured to correspond to a crevice angle of the chamfered shape of the crevice. For example, the angle of the v-shape may be between 30 degrees and 90 degrees, or in some examples the angle may be greater than 45 degrees or less than 100 degrees. Also, in some examples, the v-shape of the protruding edge may protrude a distance from the nozzle end of the hollow body that is less than a threshold depth of a ground crevice, such as less than a threshold depth of 30 mm or less than 20 mm or less than 10 mm in some examples.

In some implementations, the nozzle end of the hollow body includes a front wall, a rear wall, and side walls that interconnect between the front and rear walls to surround the intake opening. For example, the front and rear walls may be longer than the side walls to form an oblong shape at the intake opening. In some examples, the scrapping member is attached at least partially along the front wall of the nozzle end and extends beyond the at least one of the side walls to define the protruding edge. Also, in some instances, a support portion may protrude inward from the rear wall and disposed in contact with an interior surface of the front wall to support the front and rear walls at a spaced distance from each other.

In some examples, the material property includes one or more of a material type, material thickness, rigidity, or density. The hollow body and scrapper portion, in some implementations, are integrated as a common piece, such as with the use of an injection molded or blow molded polymer or the like. In some examples, a handle disposed on an exterior of the hollow body between the nozzle end and the attachment end. For instance, the handle may include ergonomic finger formations. Also, in some implementations, the hollow body and the handle may be a single integral piece.

The details of one or more implementations of the disclosure are set forth in the accompanying drawings and the description below. Other aspects, advantages, purposes, and features will be apparent upon review of the following specification in conjunction with the drawings.

BRIEF DESCRIPTION OF THE DRAWINGS

Like reference numerals indicate like parts throughout the drawings.

DETAILED DESCRIPTION

Figure 1:
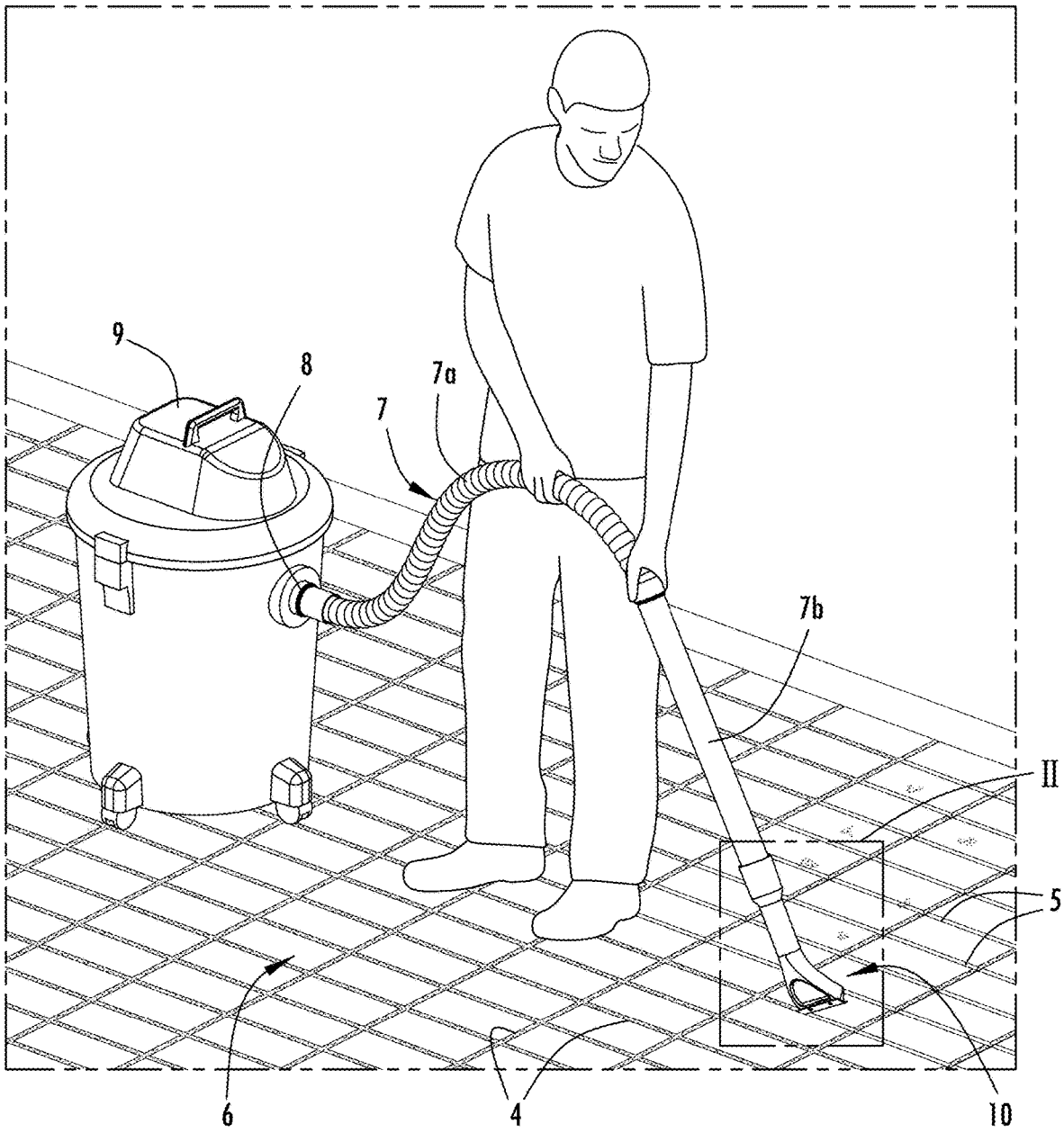
FIG. 1 is an operational perspective view of a vacuum attachment tool.

Referring now to the drawings and the illustrative embodiments depicted therein, an example of a vacuum attachment tool 10 is illustrated with reference number 10. The vacuum attachment tool 10 is configured to be attached to a suction receptacle of a vacuum appliance 9 via an intake conduit, such as a vacuum hose 7, lance, or other flexible or non-flexible tube. For example, as shown in FIG. 1, the vacuum hose 7 connects to and extends from the connection aperture 8 on the vacuum appliance 9 that defines the suction receptacle. The vacuum hose 7 may be any type of vacuum hose 7 including being retractable, bendable, or any type of conduit configured to draw air and debris into a vacuum appliance 9. The vacuum hose 7, for example as shown in FIG. 1, includes a flexible section 7*a* attached to the vacuum appliance 9 and a rigid section 7*b* or extension wand that can optionally be used with the flexible section 7*a*, such as to allow for standing or more upright use of the vacuum attachment tool 10. It is also understood that in some examples the tubular wand extension 7*b* may be considered a part of the vacuum attachment tool 10. The vacuum appliance 9 may be any vacuum device or appliance including, but not limited to, an upright vacuum, a canister vacuum, a cordless vacuum, a stick vacuum, a robotic vacuum, a wet or dry vacuum, or a central vacuum component or system.

The vacuum attachment tool 10 includes a hollow body 12 that defines an interior suction path or channel that extends between a first opening 14 and a second opening 16. In other words, the first opening 14 is fluidly coupled to or in fluid communication with the second opening 16 via the interior suction path. The hollow body 12 has a smooth interior surface to easily permit the flow of air and debris through the hollow body along the suction path. As shown in FIG. 2A, the first opening or attachment opening 14 is disposed at a proximal end or attachment end 12*a* of the hollow body 12 and the second opening or intake opening 16 is disposed at a distal end or nozzle end 12*b* of the body 12. The attachment end 12*a* of the hollow body 12 is configured to attach to a vacuum, such as via the vacuum hose 7 shown in FIG. 1. The interior suction path is generally surrounded by and bound by the solid wall structure that forms the hollow body 12 of the attachment tool 10. The vacuum located remotely from the hollow body generates air flow and draws air, debris, and the like from and around the intake opening 16 along the suction path through the hollow body 12 and to the vacuum appliance 9.

Figure 2:
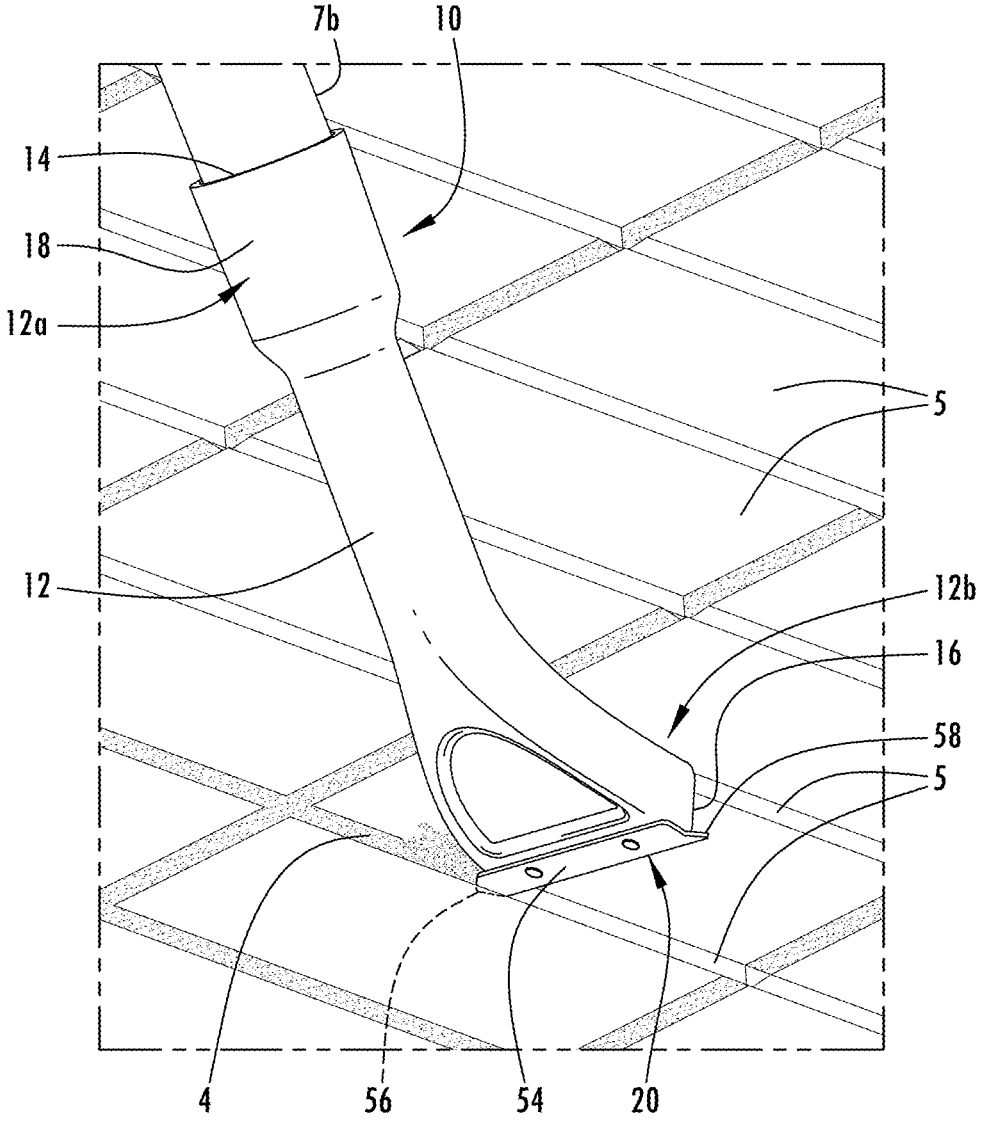
FIG. 2 is an enlarged view of the vacuum attachment tool shown in FIG. 1 used in a debris scraping position.
Figure 3:
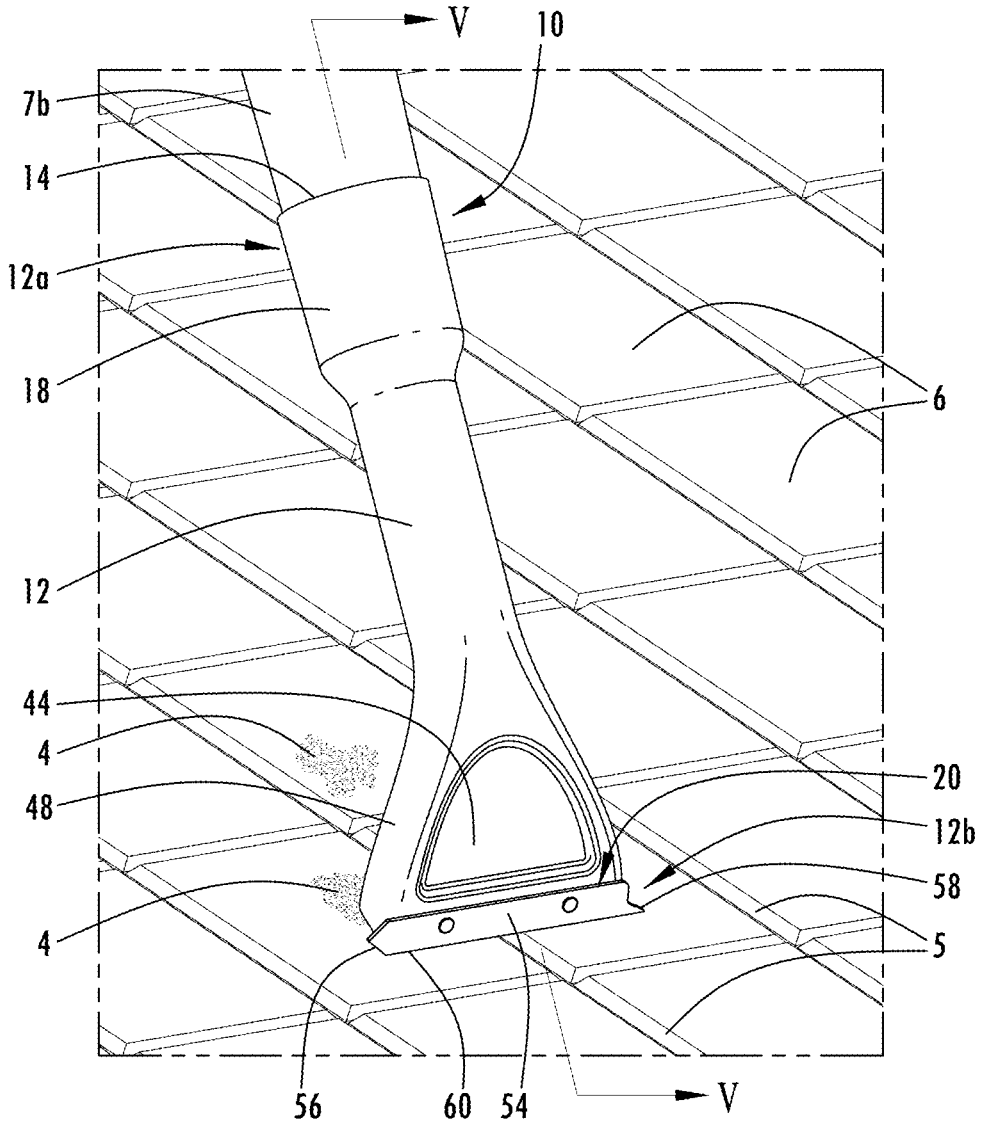
FIG. 3 is an enlarged view of the vacuum attachment tool shown in FIG. 1 used in a debris removal position.
Figure 4A:
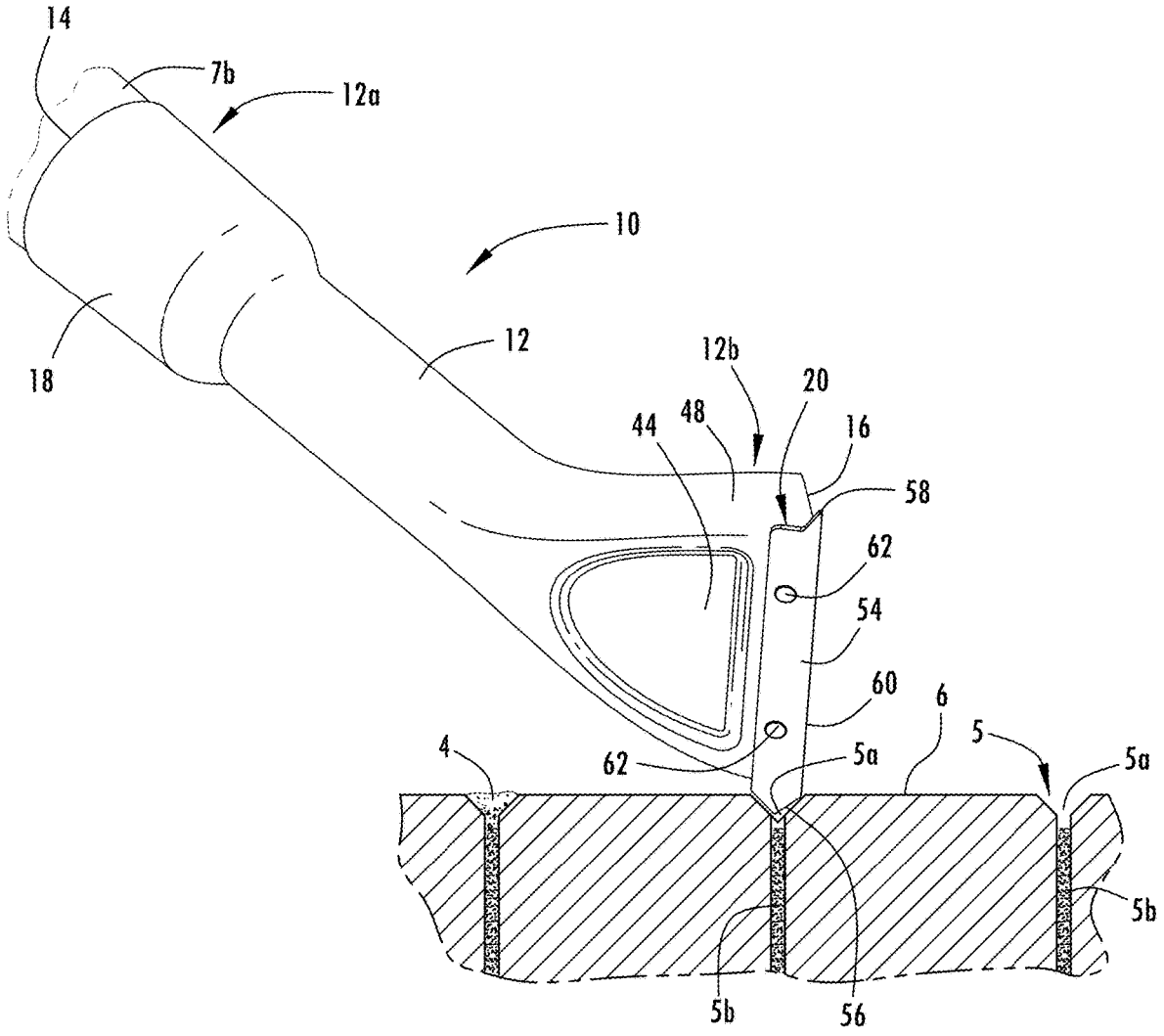
FIG. 4A is a side view of the vacuum attachment tool shown in FIG. 2 in the debris scraping position.
Figure 4B:
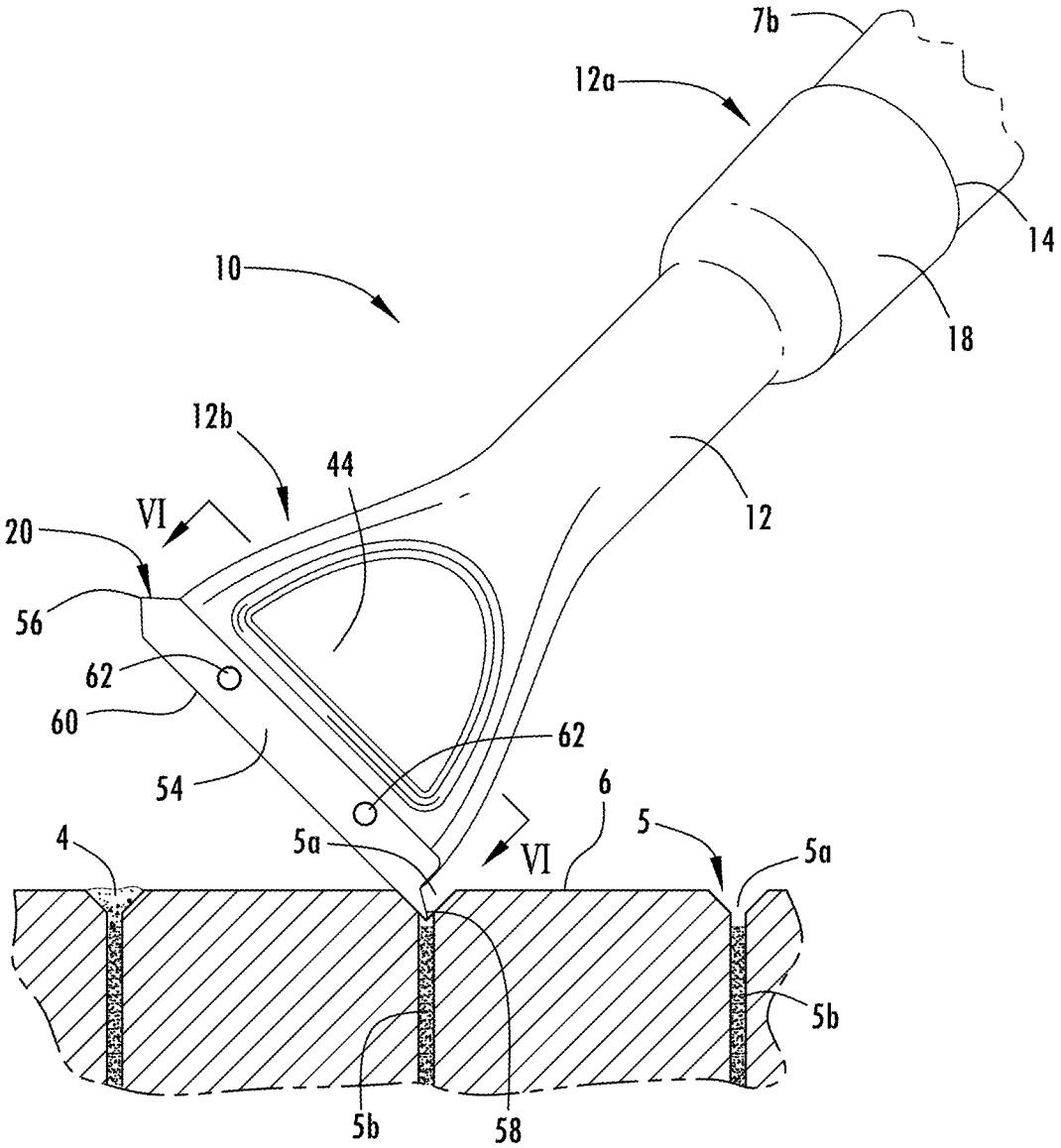
FIG. 4B is a side view of the vacuum attachment tool shown in FIG. 2 in a second debris scraping position.
Figure 5:
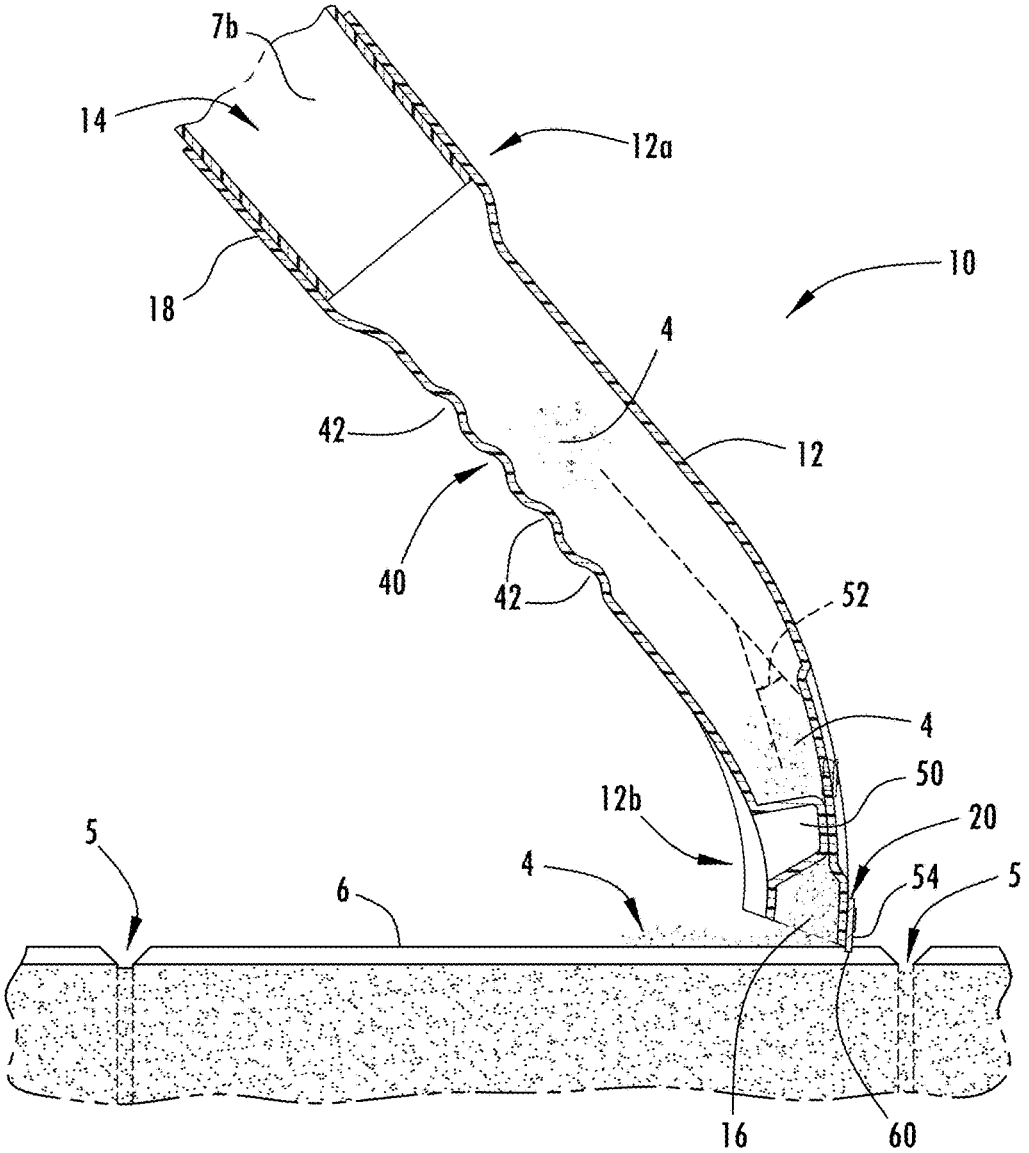
FIG. 5 is a cross-sectional view of the vacuum attachment tool taken at line V-V shown in FIG. 3 in the debris removal position.

As shown in the example illustrated in FIGS. 1-5, a ground surface is formed with an arrangement of brick pavers 6 that form crevices 5 along the seams between the pavers 6. As shown in FIG. 4A, the crevices 5 include a chamfered portion at the upper area 5*a* of the crevice and a narrowed portion at a lower area 5*b* of the crevice 5. The narrowed portion at the lower area 5*b* of the crevice 5 holds jointing sand or other stabilization substrate that supports and stabilizes the pavers relative to each other and strengthens the overall ground surface. The chamfered portion at the upper area 5*a* of the crevice 5 has accumulated debris 4, which may include dirt, plant matter, and any other undesirable organic or inorganic material. As shown in FIGS. 2 and 4A, the v-shape of the scrapper portion 20 engages in the chamfered portion of the crevice between brick pavers, such that upon moving the scrapper portion in and along the chamfered crevice, it loosens and removes the accumulated debris in the chamfered upper portion 5*a* without disturbing the material in the lower portion 5*a* of the crevice. As the accumulated debris is scrapped loose from the crevice 5, the vacuum air flow may simultaneously draw the debris into the intake opening 16 from the ground surface. Once loosened and removed from the crevice with the scrapping portion 20, as shown in FIGS. 3 and 5, the vacuum attachment tool 10 may be rotated axially 90 degrees for the wider extent of the intake opening 16 to be moved over the loosened debris 4. In doing so, the planar edge of the scrapper portion extending along the wider extent of the intake opening 16 is moved over the ground surface at the upper surface of the pavers in a manner that removes the dislodged debris 4 from the ground surface, again without disturbing the substrate between the brick pavers below the chamfered portion of the crevice 5.

The proximal or attachment end 12*a* of the hollow body 12 and the corresponding attachment opening 14 is configured to be coupled to the vacuum hose 7, such as in a releasable or removable engagement. For example, such as shown in FIGS. 1-3, the attachment end 12*a* is friction fit to the end of the tubular wand extension 7*b* of the vacuum hose 7 with a tapered conical matting surface. The friction fit may generally be formed by the attachment opening 14 being sized and shaped to receive the diameter of a vacuum hose 7. The attachment opening 14 at the attachment end 12*a* shown in FIGS. 1-5 is generally circular in shape; however, in additional examples may be any size or shape to couple to any type of vacuum hose. In other examples, the attachment end 12*a* may be received in the end of the vacuum hose. Moreover, the body may be coupled by any means including, but not limited to press fit coupling, a manual latch mechanism, an automatic latch mechanism, or magnetic coupling.

In some examples, the attachment end 12*a* of the hollow body 12 includes an engagement portion 18 that surrounds the attachment opening 14. The engagement portion 18 is a portion of the vacuum attachment tool 10 which a user can grasp and engage with the vacuum hose 7 or other intake receptacle to secure the first opening 14 to the vacuum hose 7. As shown in FIGS. 2-5, the engagement portion 18 is formed as a collar with a larger diameter than the hollow body 12 more distally located from the attachment to the hose 7, such that user engagement and coupling is robust at the point of engagement. Additionally, a user may use the engagement portion 18 to grasp and guide or maneuver the vacuum attachment tool 10 during operation.

In the example illustrated in FIGS. 1-5, the engagement portion 18 has approximately a quarter of a length of the hollow body 12 between the attachment opening 14 and the intake opening 16. However, various other shapes and sizes of engagement portions 18 are contemplated, including but not limited to a different length and an engagement portion with a different diameter, such as the same diameter as the remainder of the hollow body. As further shown in FIGS. 1-10, the example of the hollow body 12 has a handle portion 40 disposed on and integrated with an exterior surface of the hollow body 12 between the attachment end 12*a* and the nozzle end 12*b*. For instance, as shown in FIGS. 5 and 7, the handle portion 40 includes ergonomic finger formations 42 that protrude into the interior of the hollow body to conform the shape of the handle portion 40 to a user's hand for providing locating features for user hand placement and an ergonomic and secure grip.

Figure 6:
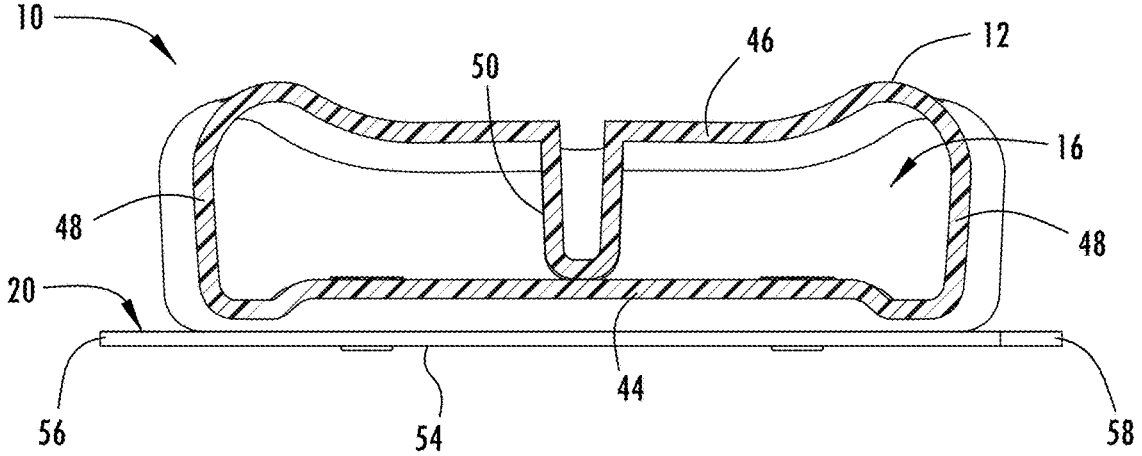
FIG. 6 is a cross-sectional view of the vacuum attachment tool taken at line VI-VI shown in FIG. 4B.
Figure 7:
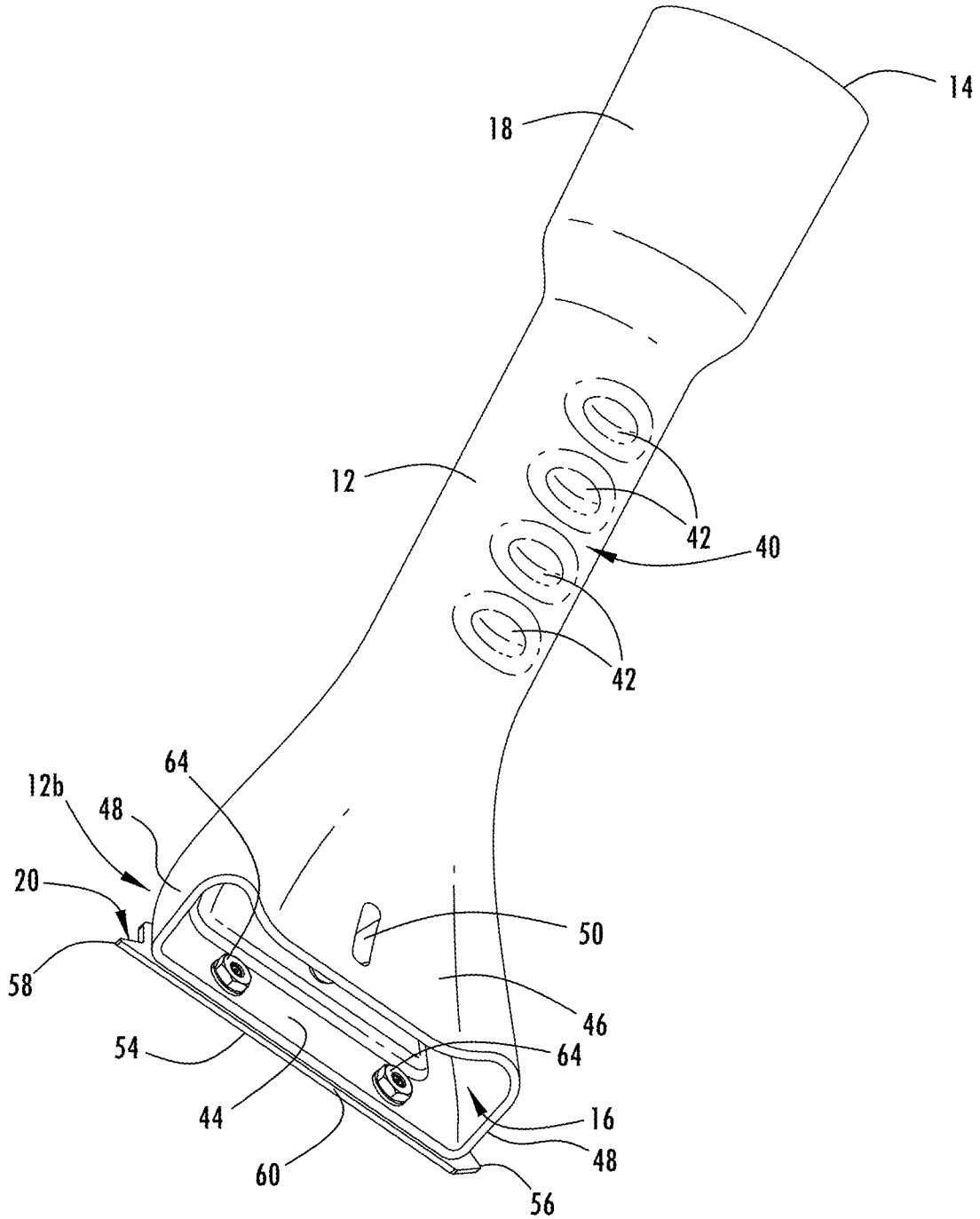
FIG. 7 is a lower rear perspective view of the vacuum attachment tool.
Figure 8:
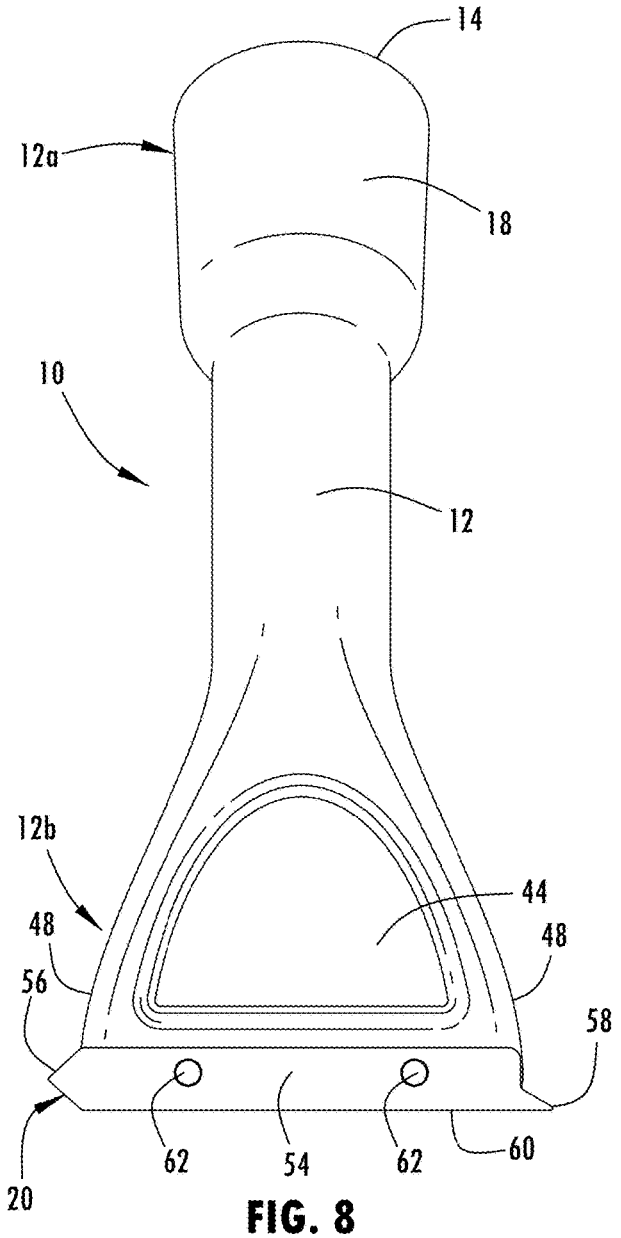
FIG. 8 is a front view of the vacuum attachment tool.
Figure 9:
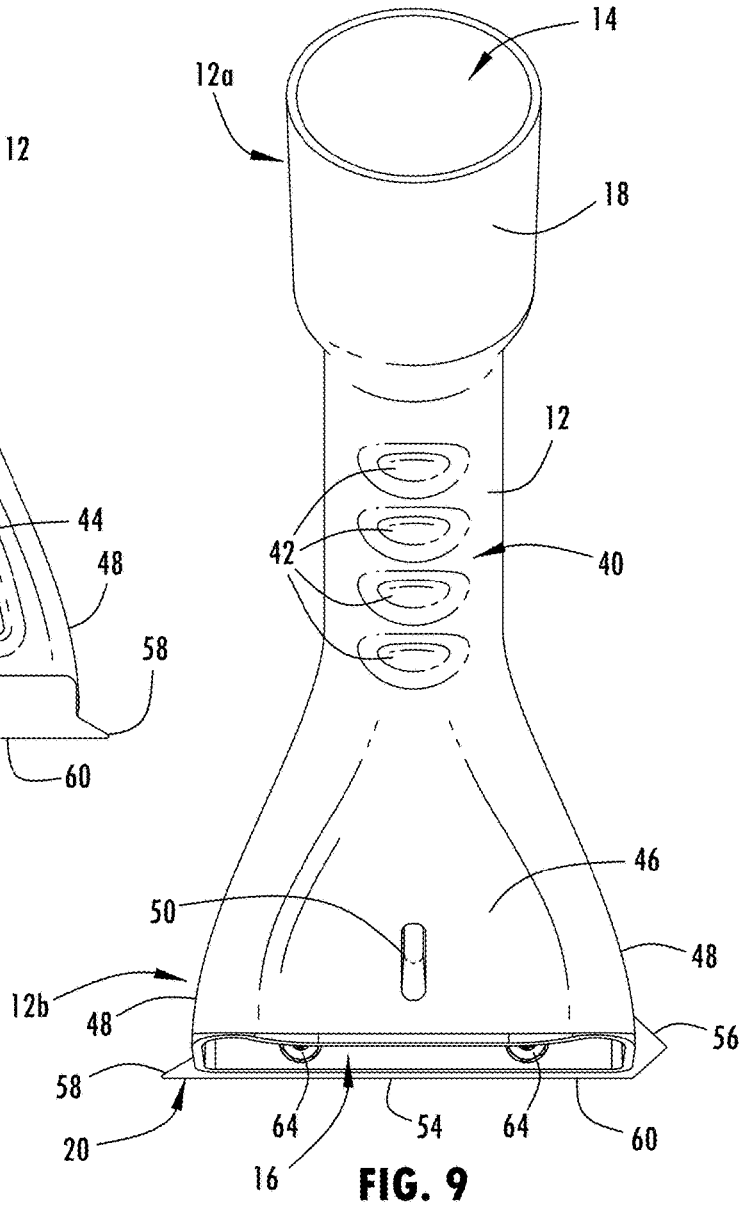
FIG. 9 is a rear view of the vacuum attachment tool.

As also shown in FIGS. 2-10, the hollow body 12 of the vacuum attachment tool 10 includes a solid wall structure that surrounds the interior suction path. The hollow body and handle portion, in some implementations, are integrated as a common piece, such as with the use of an injection molded or blow molded polymer or the like. In this example, the hollow body 12 has a generally tubular shape with the nozzle end 12*b* including flared shape in a width dimension and a narrowed shape in the longitudinal dimension that is orthogonal to the width, such as to provide an oblong intake opening 16 as shown in FIG. 6. The material and thickness of the walls of the hollow body are substantially uniform along its length so as to generally provide rigidity to the structure of the hollow body 12. For example, the body and sidewall may be made of a sufficiently robust and rigid material, such as a plastic material (i.e., a molded plastic or composite material) or a metal material (i.e., steel or aluminum) or a like material or composites thereof.

The intake opening 16 is configured to allow debris to be moved from adjacent to the intake opening 16, through the body 12 and to the vacuum hose 7. As shown in FIG. 5, the hollow body 12 is tapered between the attachment opening 14 and the intake opening 16. In other words, in one example, the attachment opening 14 is generally round and has a first diameter and the intake opening 16 has a second diameter, such as the longitudinal dimension, which is smaller than the first diameter of the attachment opening 14. The tapered shape may be configured to increase air flow into the intake opening 16. However, the extent of the tapered shape may be configured to not restrict the diameter at the second opening 16 in a manner that would cause debris to block or accumulate at the intake opening 16.

As the hollow body 12 extends form the handle portion 40 toward the intake opening 16, as shown in FIG. 5, it also include a slight curvature or bend 52 of approximately 30 degrees between the longitudinal extent through the handle portion 40 and the attachment opening 14 and the longitudinal extent of the intake opening 16. In some examples, the bend is approximately 20-80 degrees and is configured to provide a desirable angle for the scrapper portion to engage with the ground and ground crevice without an undesirable user position. In other examples, the bend is approximately 30-70 degrees. In still other examples, the bend is approximately 40-60 degrees.

As shown in FIGS. 6-10, the nozzle end 12*b* of the hollow body 12 includes a front wall 44, a rear wall 46, and side walls 48 that interconnect between the front and rear walls 44, 46 to surround the intake opening 16. The front and rear walls 44, 46, as shown in FIG. 6 are longer than the side walls 48 along the width dimension of the hollow body 12 to form an oblong shape at the intake opening 16. Also, a support portion 50 protrudes inward from the rear wall 46 and is disposed in contact with an interior surface of the front wall 44 to support the front and rear walls 44, 46 at a spaced distance from each other. The support portion 50 extends along an intermediate portion of the nozzle end 12*b* where it divides the interior suction path into two adjacent channels. In doing so, the support portion 50 also can provide an obstacle for large debris that can help to break apart larger debris pieces that may otherwise accumulate in other sections along the interior suction path.

As further shown in FIGS. 2-10, the vacuum attachment tool 10 also includes a scrapper portion 20 disposed at the nozzle end 12*b* of the hollow body 12. The scrapper portion 20 includes a scrapping member 54 that is attached at the nozzle end 12*b* of the hollow body 12 and protrudes outward from the intake opening 16. the scrapping member includes a rigid piece that is a separate piece from the hollow body and that is attached at least partially along a distal edge of the nozzle end of the hollow body In some examples, the scrapping member includes a planar plate, such as a strip of metal. For instance, in some implementations, the scrapping member 54 is a metal blade. The scrapper portion has multiple scrapping surfaces that are adapted for different uses.

As shown in FIGS. 2-10, a protruding edge 56 of the scrapping member 54 that protrudes outward from the exterior surface of the hollow body 12 has a v-shape that is configured to correspond to a chamfered shape of the ground crevice 5 for scraping the debris 4 from the ground crevice 5. The protruding edge 56 of the scrapping member has a first linear edge and a second linear edge of the planar plate that meet at a point and together define the v-shape. The v-shape may form an angle that is configured to correspond to a crevice angle of the chamfered shape of the crevice (FIG. 4A). For example, the angle of the v-shape may be between 30 degrees and 90 degrees, or in some examples the angle may be greater than 45 degrees or less than 100 degrees. Also, in some examples, the v-shape of the protruding edge 56 may protrude a distance from the nozzle end 12*b* of the hollow body 12 that is less than a threshold depth of a ground crevice, such as less than a threshold depth of 30 mm or less than 20 mm or less than 10 mm in some examples.

As further shown in FIGS. 2-10, the scrapping member 54 includes a second portion 58 that protrudes outward from the intake opening at an opposite end of the scrapping member 54. The second portion 58 has a different shape from the protruding edge 56; although it may be similar or identical in other implementations. In this example, the second portion 58 has smaller spike shape with a tighter angle than the v-shape of the protruding edge. For example, the spike shape may be used to cut roots or other pieces of debris that are difficult to remove with the protruding edge 56 of the scrapper member 54 (FIG. 4B). The spike shape may also protrude a distance from the nozzle end 12*b* of the hollow body 12 that is less than a threshold depth of a ground crevice, such as less than a threshold depth of 30 mm or less than 20 mm or less than 10 mm.

Further, as shown in FIGS. 2-10, the scrapping member 54 includes a planar edge 60 that extends between the protruding portions 56, 58 at the opposing ends of the scrapping member 54 and along the wider extent of the intake opening 16. As shown in FIG. 5, the planar edge 60 is moved over the ground surface at the upper surface of the pavers in a manner that removes the dislodged debris 4 from the ground surface, again without disturbing the substrate between the brick pavers below the chamfered portion of the crevice 5.

Figure 10:
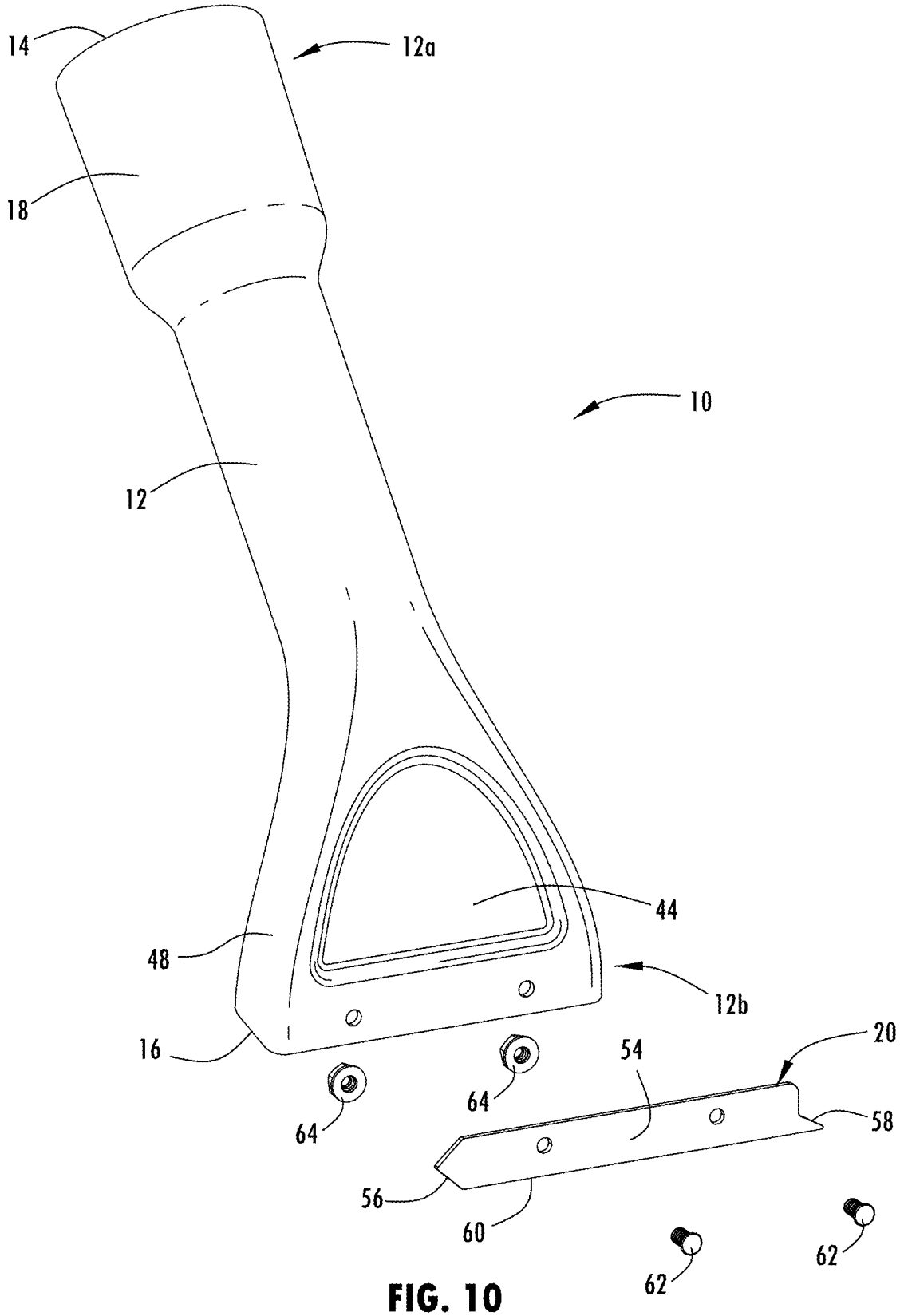
FIG. 10 is an exploded upper front perspective view of the vacuum attachment tool.

The scrapping member 54 is securely attached to the hollow body 12 along the front wall 44 of the nozzle end 12*b*. As shown in FIG. 10, the front wall 44 include fastener apertures that align with apertures in the scrapping member 54 so as to receive threaded fasteners 62 that engage nuts 64 that interface with the interior surface of the front wall 44. The fasteners 62 allow the scrapping member 54 to be removed and replaced, such as when the protruding portions 56, 58 become dull, bent, or worn. In additional examples, the scrapping member may be attached to the hollow body in various forms of attachment, such as insert molding, adhesive, friction fit, rivets, fasteners or combinations thereof.

Moreover, the scrapping member may be comprised of a rigid and durable material, such as a metal, polypropylene, fiber composite, or the like. Also, it is contemplated that the scrapping member may be sharpened or textured to provide additional scrapping capability.

In operation, a user will engage the vacuum attachment tool 10 at a location, including but not limited to at the handle portion 40 as described above, and couple the attachment opening 14 of the hollow body 12 to the vacuum hose 7, such as via an extension wand, of a desired vacuum appliance 9. The user will then perform any manual latching or locking as necessary to ensure proper engagement. Once the vacuum attachment tool 10 is coupled with the vacuum hose 7, the user will place the protruding portion of the scrapper portion 20 in the ground crevice that includes debris that the user wishes to remove. When the vacuum appliance 9 is powered on, the user may move the vacuum attachment tool 10 forward and backward within the ground crevice to loosen and remove the debris. The loose debris may simultaneously move from the ground crevice through the intake opening 16 and into the vacuum hose 7. Once the debris is loosened, the user may rotate the vacuum attachment tool 10 axially to position the wide portion of the intake opening against the ground surface and vacuum any remaining loosened debris. Using the scrapper portion 20 may be repeated until all remaining debris has been removed from the ground crevice. The user may then engage the engagement portion 18, or another portion as described in more detail below, to move the vacuum attachment tool 10 to the next ground crevice having debris to remove. When the user is finished, the vacuum attachment tool 10 can be disengagement from the vacuum hose 7 of the desired vacuum appliance 9 and stored until the next desired use.

Figure 11A:
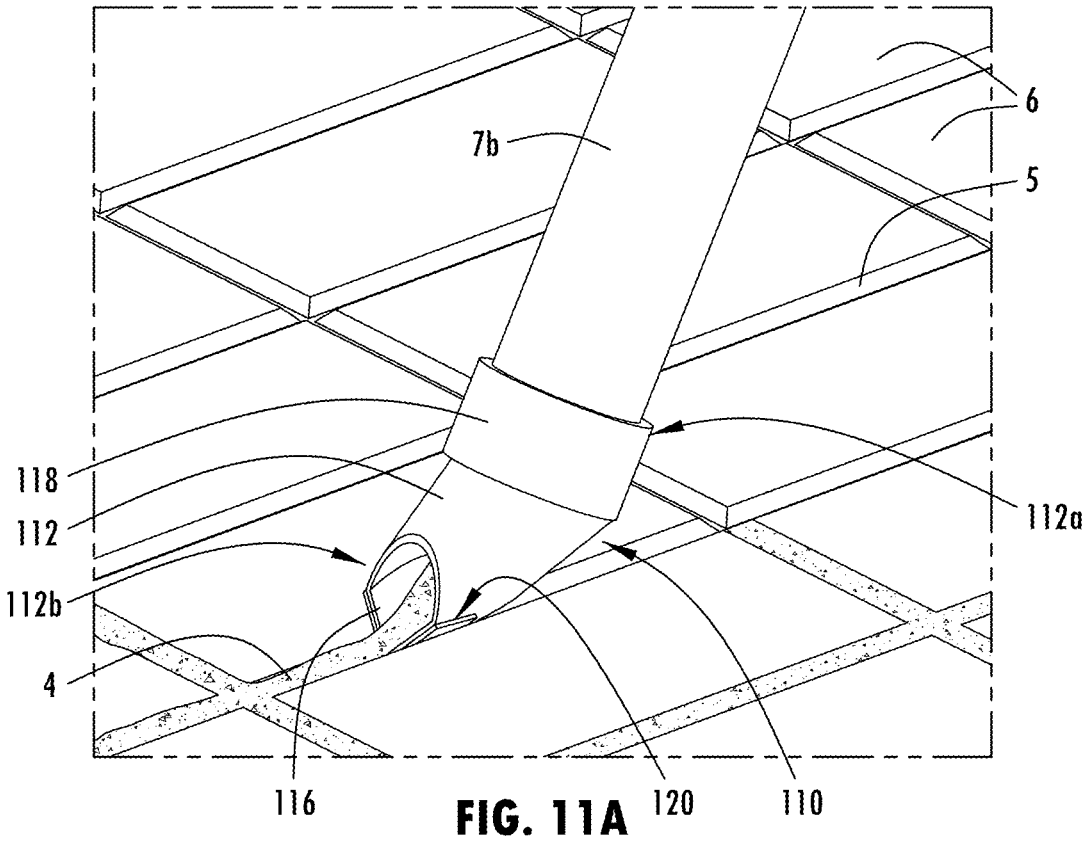
FIG. 11A is an operational perspective view of an additional example of a vacuum attachment tool.

Referring now to the example shown in FIGS. 11A-11D, an additional example of a vacuum attachment tool 110 is provided similarly to that illustrated in FIGS. 1-10. Similar reference numbers are provided in FIGS. 11A-11D to those shown in FIGS. 1-10 incremented by 100 to represent like features. Like the prior example, the proximal end 112*a* of the hollow body 112 and the corresponding first or attachment opening 114 is configured to be coupled to the vacuum hose 7, such as in a releasable or removable engagement. As shown in FIG. 11A, the proximal end 112*a* is friction fit to the end of the vacuum hose 7. The friction fit may generally be formed by the first opening 114 being sized and shaped to receive the diameter of a vacuum hose 7. The first opening 114 at the proximal end 112*a* shown in FIG. 11A is generally circular in shape; again, however, additional examples may be any size or shape to couple to any type of vacuum hose and may also include a latch mechanism or magnetic coupling or the like.

As shown in FIGS. 11A-11D, the hollow body 112 includes an engagement portion 118 surrounding the first opening 114. The engagement portion 118 is a portion of the vacuum attachment tool 110 which a user can engage with the vacuum hose 7 or other intake receptacle to secure the first opening 114 to the vacuum hose 7. As shown in FIG. 11A, the engagement portion 118 has a collar of thicker material than the distal end 112*b* of the body 112, such that user engagement and coupling is more robust and sturdier at the point of engagement. Additionally, a user may use the engagement portion 118 to grasp and guide or maneuver the vacuum attachment tool 110 during operation. In the example illustrated in FIGS. 11A-11D, the engagement portion 118 has a ring shape surrounding the first opening 114 and extends approximately half of a length of the body 112 between the first opening 114 and the second or intake opening 116.

As also shown in FIGS. 11A-11D, the hollow body 112 of the vacuum attachment tool 110 includes a sidewall that surrounds the interior suction path, such as to form a substantially tubular shape. The material and thickness of the sidewall is configured to provide rigidity to the hollow body 112. For example the body and sidewall may be made of a sufficiently robust and rigid material, such as a plastic material (i.e., a molded plastic or composite material) or a metal material (i.e., steel or aluminum) or a like material or composite thereof.

The second or intake opening 116 of the example shown in FIGS. 11A-11D is configured to allow debris to be moved from adjacent to the second opening 116, through the body 112 and to the vacuum hose 7. In one example, the body 112 is tapered between the first opening 114 and the second opening 116. In other words, the first opening 114 is generally round and has a first diameter and the second opening 116 has a second diameter smaller than the first diameter of the first opening 114. The tapered shape may be configured to increase air flow into the second opening 116. The hollow body 112 shown in FIG. 11D also include a bend between the first opening 114 and the second opening 116 of approximately 50 degrees, such as approximately 20-80 degrees or 30-70 degrees or 40-60 degrees.

Figure 11B:
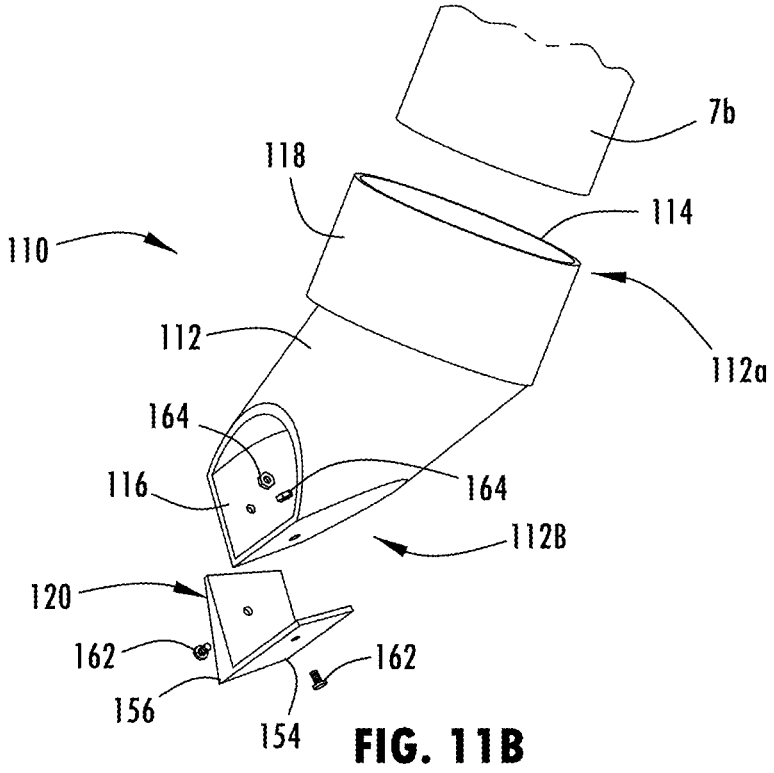
FIG. 11B is an exploded view of the vacuum attachment tool shown in FIG. 11A.
Figure 11C:
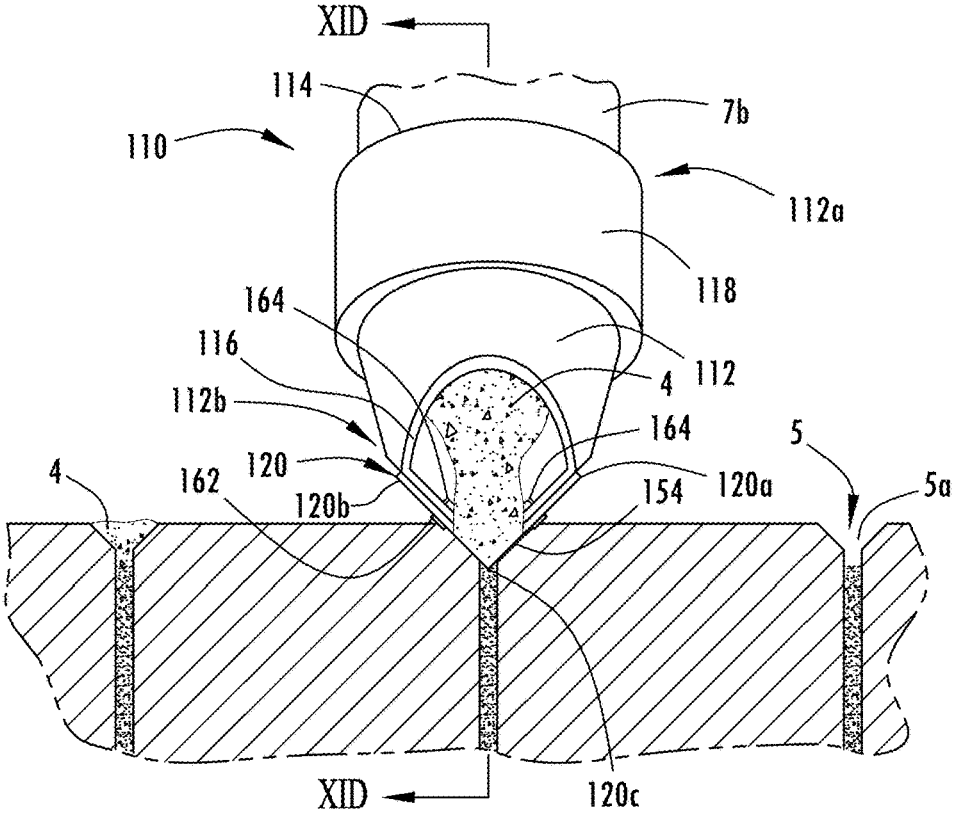
FIG. 11C is a front view of the vacuum attachment tool shown in FIG. 11A.

As shown in FIGS. 11A-11D, the vacuum attachment tool 110 also includes a scrapper portion 120 disposed at the distal end of the body 112. As shown in FIG. 11C, the scrapper portion 120 includes a first planar member 120*a* and a second planar member 120*b* that interconnect along a bottom edge 120*c* of the scrapper portion 120. As shown in FIG. 11B, a leading edge 121 of the first and second planar members 120*a*, 120*b* defines a v-shape that protrudes radially outward from the interior suction path. The v-shape of the leading edge 121 is configured to correspond to a chamfered shape of a ground crevice, as shown in FIG. 11C. The v-shape of the scrapper portion 120 engages in the chamfered portion of the crevice between brick pavers, such that upon moving the scrapper portion in and along the chamfered crevice it removes accumulated debris in the chamfered portion. Also, the vacuum attachment tool 110 in this example directs the interior suction path forward, not down into the substrate, such that the orientation of the interior suction path prevents disturbance of substrate between the brick pavers below the chamfered portion of the crevice.

As further shown in FIGS. 11A-11D, the scrapper portion 120 includes a scrapping member 154 that is attached at the nozzle end 112*b* of the hollow body 112 and protrudes outward from the intake opening 116. The scrapping member 154 includes a rigid piece that is a separate piece from the hollow body 112 and that is attached at least partially along a distal edge of the nozzle end of the hollow body 112. The scrapping member 154 includes a planar plate, such as a strip of metal with a fold that defines the v-shape. To follow the shape of the scrapper member 154, the second opening 116 also includes a v-shaped portion that is configured to engage the ground crevice. As also shown in FIG. 11C, the portion of the second opening 116 which is opposite the v-shaped portion is rounded to allow for a larger opening through which debris may travel. In some examples, the v-shaped portion is approximately a 40-50 degree angle. However, various other angles have been contemplated, including but not limited to 25-80 degree angles.

Figure 11D:
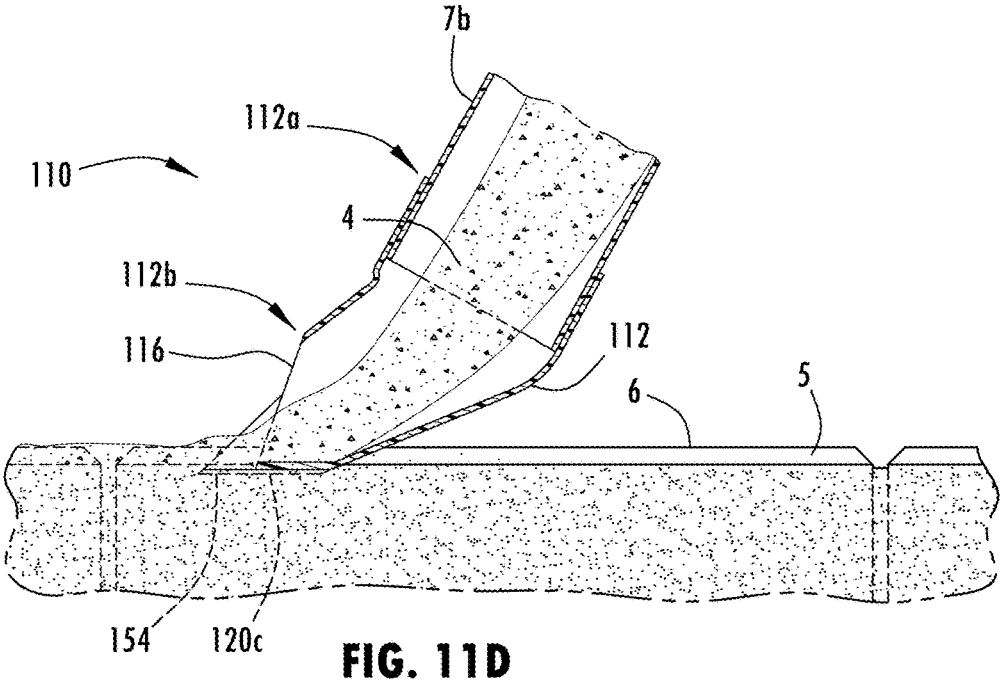
FIG. 11D is a side cross-sectional view of the vacuum attachment tool taken at line XID-XID shown in FIG. 11C.
Figure 12A:
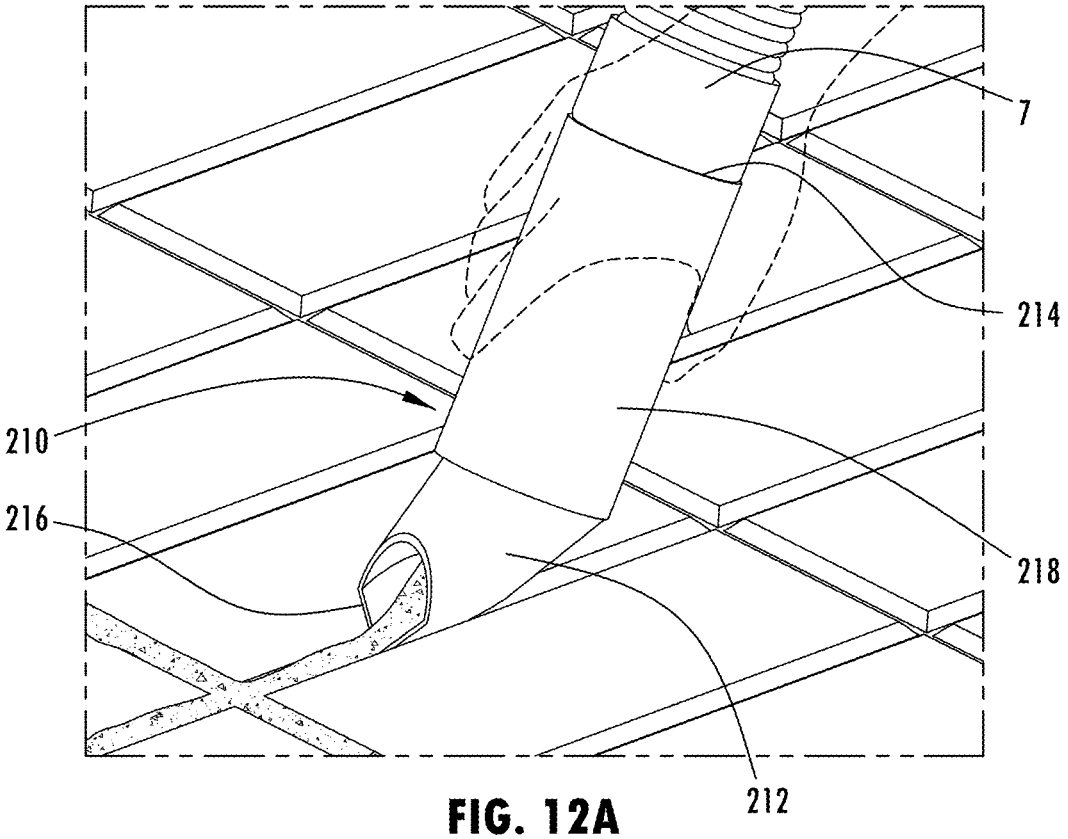
FIG. 12A is an operational perspective view of another example of a vacuum attachment tool.
Figure 12B:
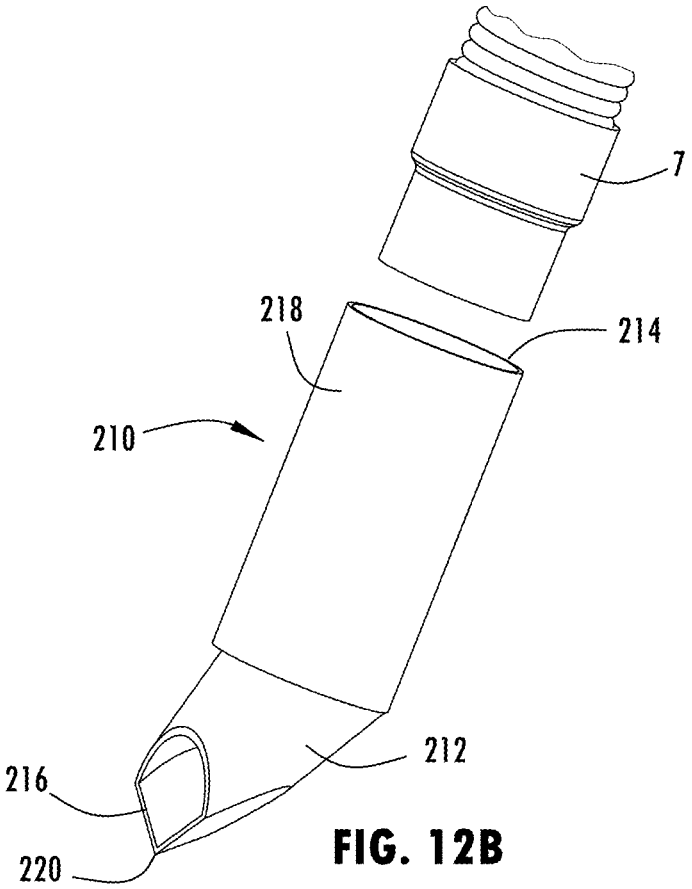
FIG. 12B is an exploded view of the vacuum attachment tool shown in FIG. 12A.
Figure 12C:
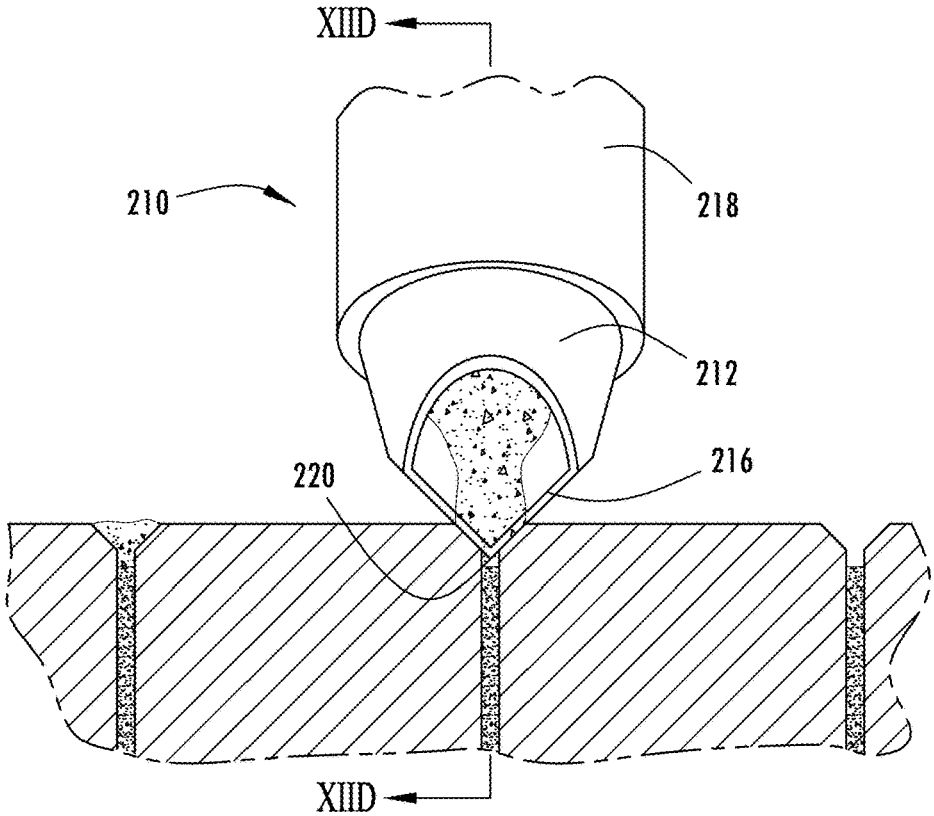
FIG. 12C is a front view of the vacuum attachment tool shown in FIG. 12A.
Figure 12D:
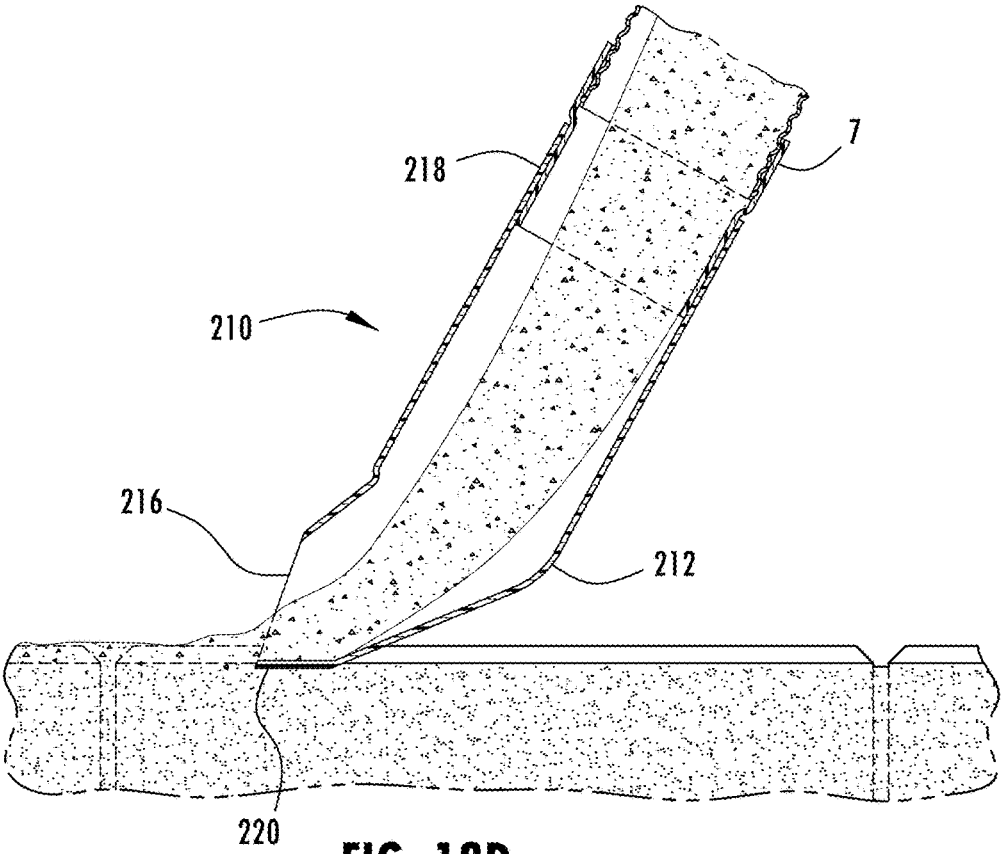
FIG. 12D is a side cross-sectional view of the vacuum attachment tool taken at line XIID-XIID shown in FIG. 12C.
Figure 13A:
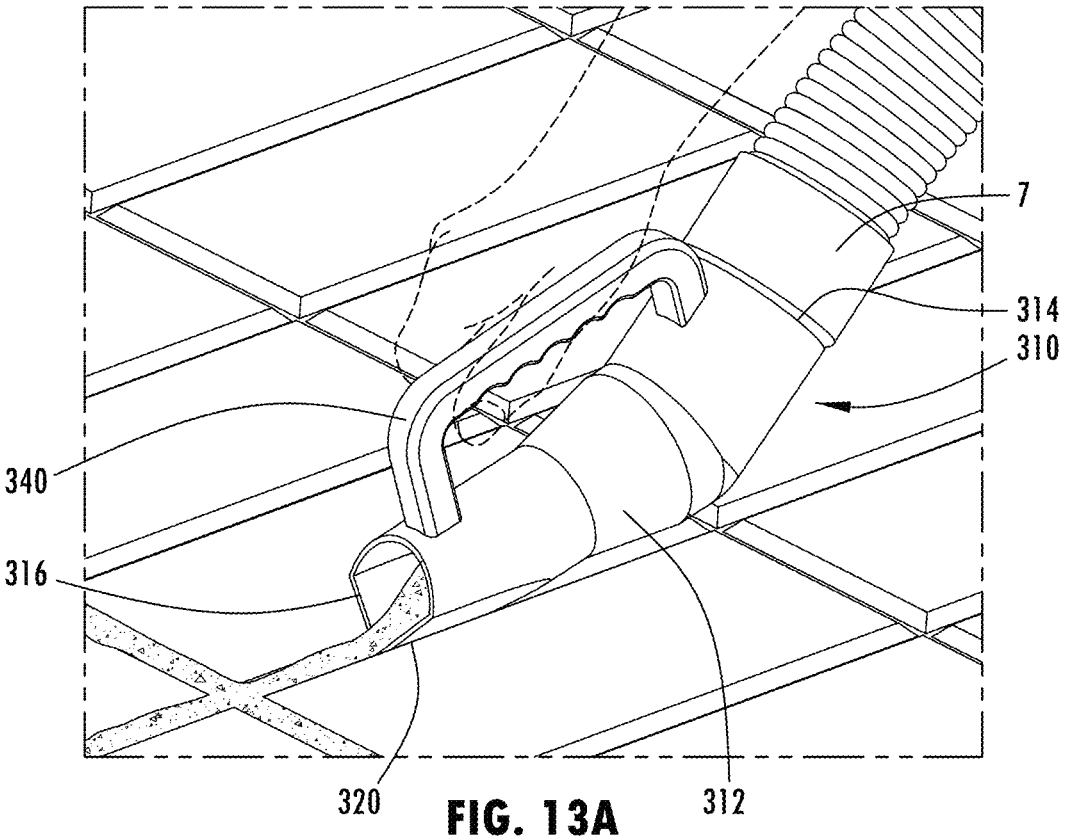
FIG. 13A is an operational perspective view of yet another example of a vacuum attachment tool.
Figure 13B:
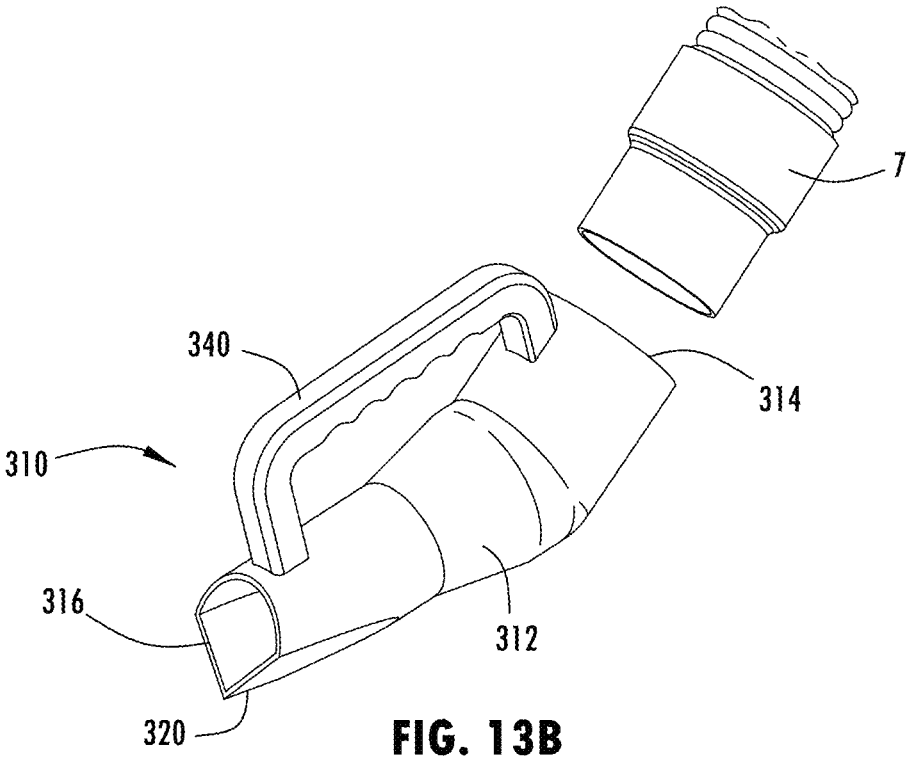
FIG. 13B is an exploded view of the vacuum attachment tool shown in FIG. 13A.
Figure 13C:
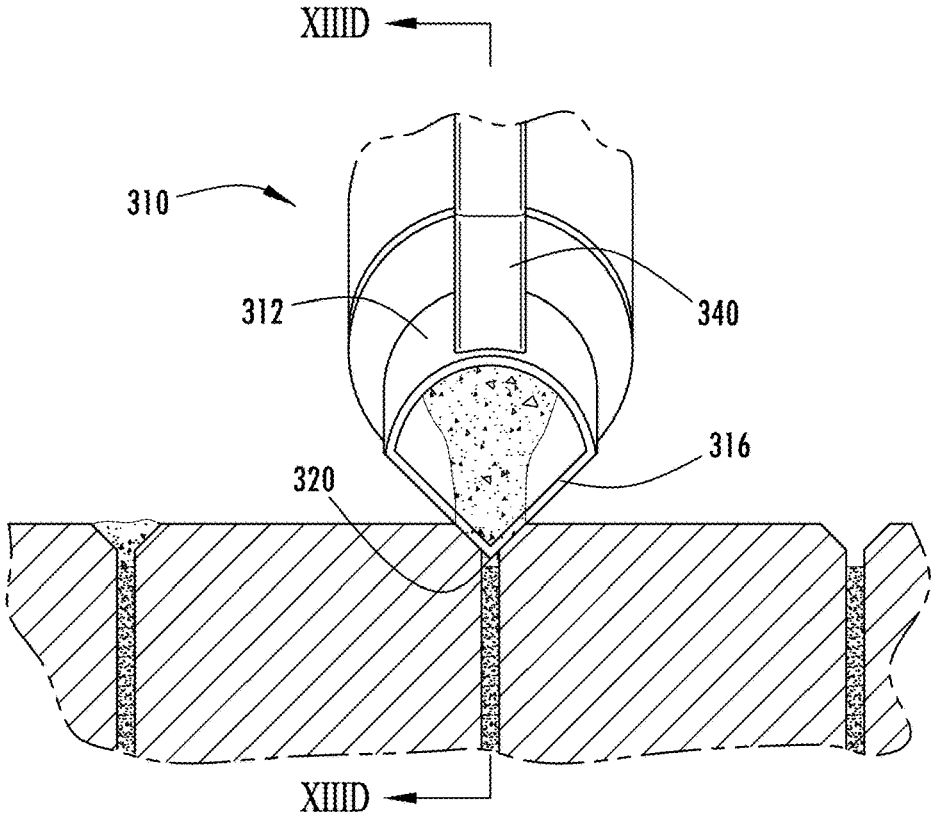
FIG. 13C is a front view of the vacuum attachment tool shown in FIG. 13A.
Figure 13D:
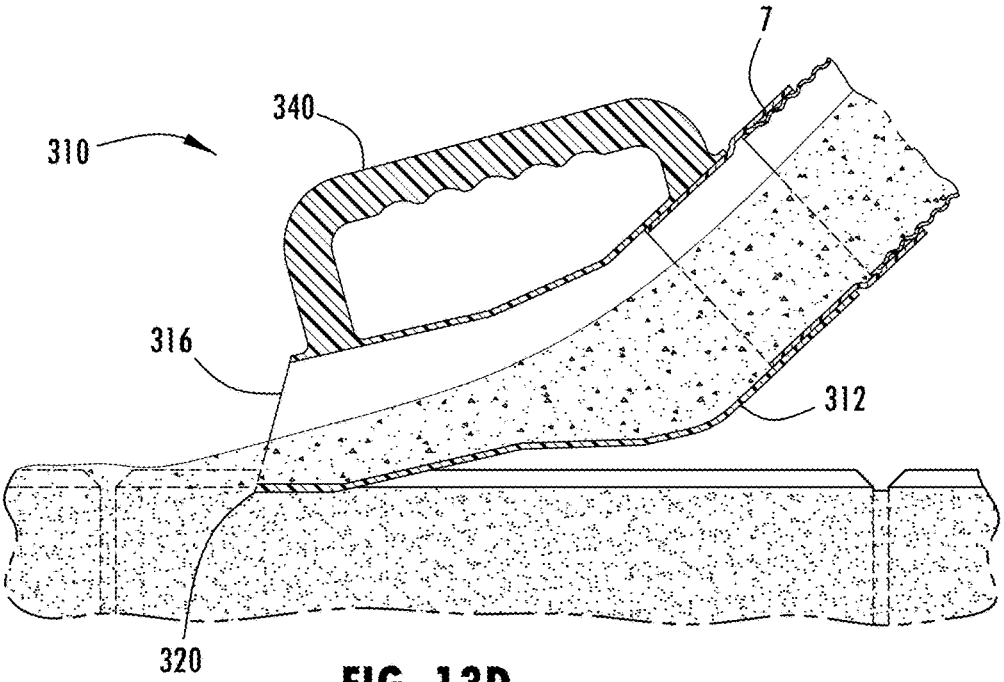
FIG. 13D is a side cross-sectional view of the vacuum attachment tool taken at line XIIID-XIIID shown in FIG. 13C.

In some examples, such as illustrated in FIGS. 11A-11D, the bottom edge 120*c* of the scrapper portion 210 extends substantially linearly along the body 112 to align with a base of the ground crevice. As shown in FIG. 11D, the leading edge 121 of the scrapper portion 120 that defines the v-shape is angled rearward relative to the bottom edge 120*c*. In doing so, the scrapper portion projects distally or forward from the at least the upper portion of the second opening 116 of the hollow body 112.

Moreover, the scrapper portion 120 is configured to engage the ground crevice. In some examples, the scrapper portion 120 is formed from a hard material and has a sharp end which is configured to help disengage debris from the ground crevice so the debris can be moved through the second opening 116 into the vacuum attachment tool 110. As shown in FIGS. 11A-11D, the scrapper portion 120 forms the exterior surface of the v-portion of the second opening 116. In some implementations, the scrapper portion is integrated with the body as a single integral piece comprised of the same material. However, as shown, the scrapper portion 120 is comprised of another material than the body 112 of the vacuum attachment tool 110, such as a metal insert used with a plastic body.

Referring now to the example shown in FIGS. 12A-12D, the vacuum attachment tool 210 is similar to the example shown in FIGS. 11A-11D, including but not limited to the body 212 extending between the first opening 214 and the second opening 216 and configured to be coupled to the vacuum hose 7, and the scrapper portion 220 protruding radially outward from the second opening 216 and having a v-shape. However, in the example shown in FIGS. 12A-12D, the engagement portion 218 of the vacuum attachment tool 210 adjacent the first opening 214 is elongated allowing additional surface area for a user to engage. In the example shown, the engagement portion 218 is sized approximately double the length of the remainder of the vacuum attachment tool 210. The additional surface area of the engagement portion 218 may allow for easy coupling and de-coupling from the vacuum hose 7 and may prevent the user from having any portion of their hands engage the ground during precise movements of the vacuum attachment tool 210 within the crevice. Additionally, the elongated engagement portion 218 provides a surface for the user to apply specific pressure to the ground crevice with the scrapper portion 220 to clean the desired debris.

Referring now to the example shown in FIGS. 13A-13D, the vacuum attachment tool 310 is similar to the example shown in FIGS. 11A-11D, including but not limited to the body 312 extending between the first opening 314 and the second opening 316 and configured to be coupled to the vacuum hose 7, and the scrapper portion 320 protruding radially outward from the second opening 316 and having a v-shape. However, in the example shown in FIGS. 13A-13D, the body 312 also includes a handle portion 340. In the example shown, the handle portion 340 extends from the engagement portion 318 adjacent the first opening 314 to adjacent to the second opening 316 having a space between the handle portion 340 and the remainder of the body 312 for user engagement. The handle portion 340 also includes a plurality of indentations configured to allow a user to easily gasp the handle. The handle portion 340 provides additional levels of control for the user of the vacuum attachment tool 310. Additionally, the second opening 316 of the body 312 includes a wider v-shape than described above. In the example shown in FIGS. 13A-13D, the v-shape is slightly wider than example shown in FIGS. 11A-11D. More specifically, in the example shown in FIGS. 13A-13D, the v-shape has an angle of approximately 40-55 degrees which enlarges the second opening 316 in comparison to the second opening 316 described in FIGS. 11A-11D. However, various other angles have been contemplated.

Figure 14A:
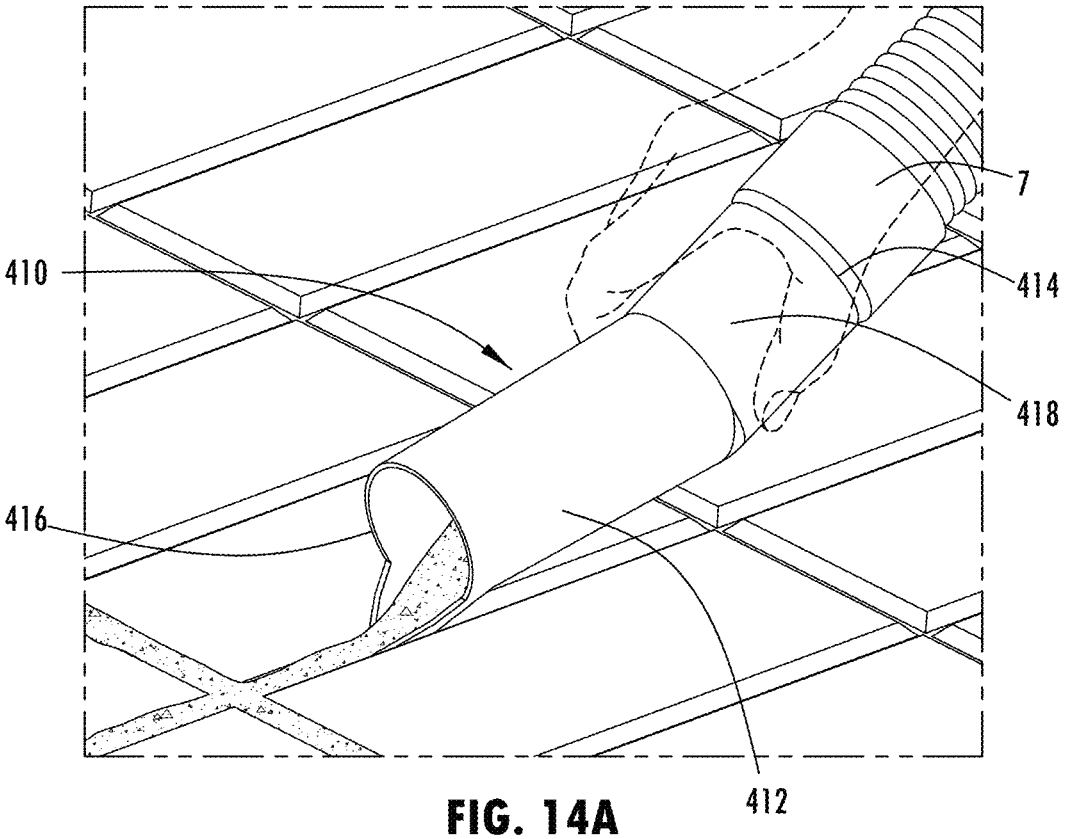
FIG. 14A is an operational perspective view of a further example of a vacuum attachment tool.
Figure 14B:
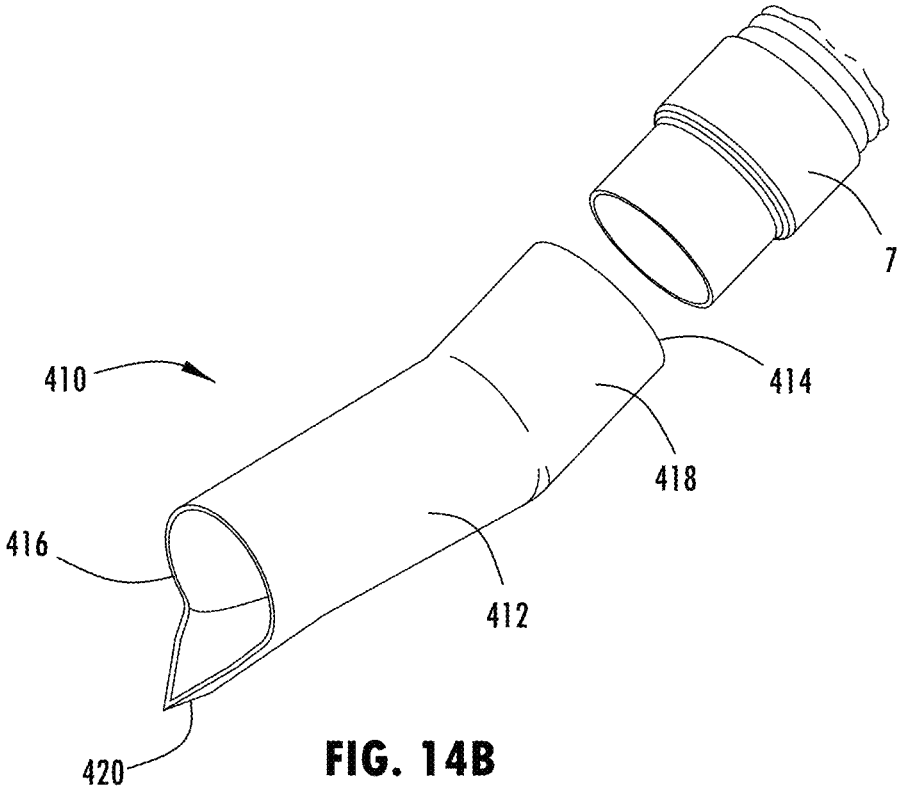
FIG. 14B is an exploded view of the vacuum attachment tool shown in FIG. 14A.
Figure 14C:
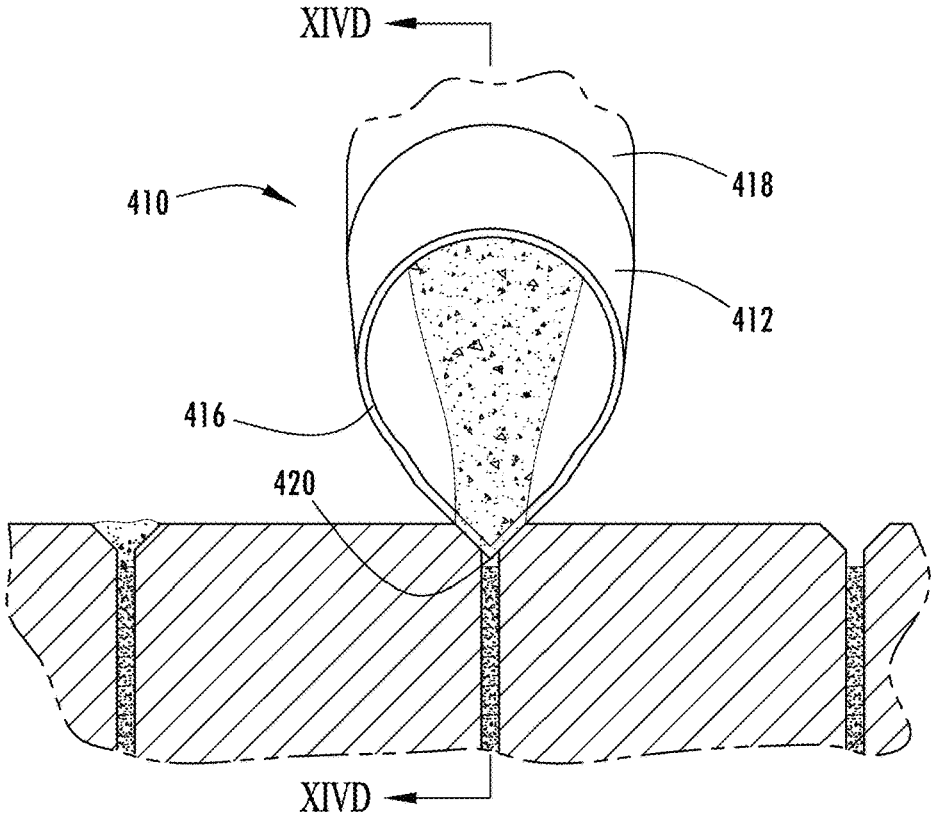
FIG. 14C is a front view of the vacuum attachment tool shown in FIG. 14A.
Figure 14D:
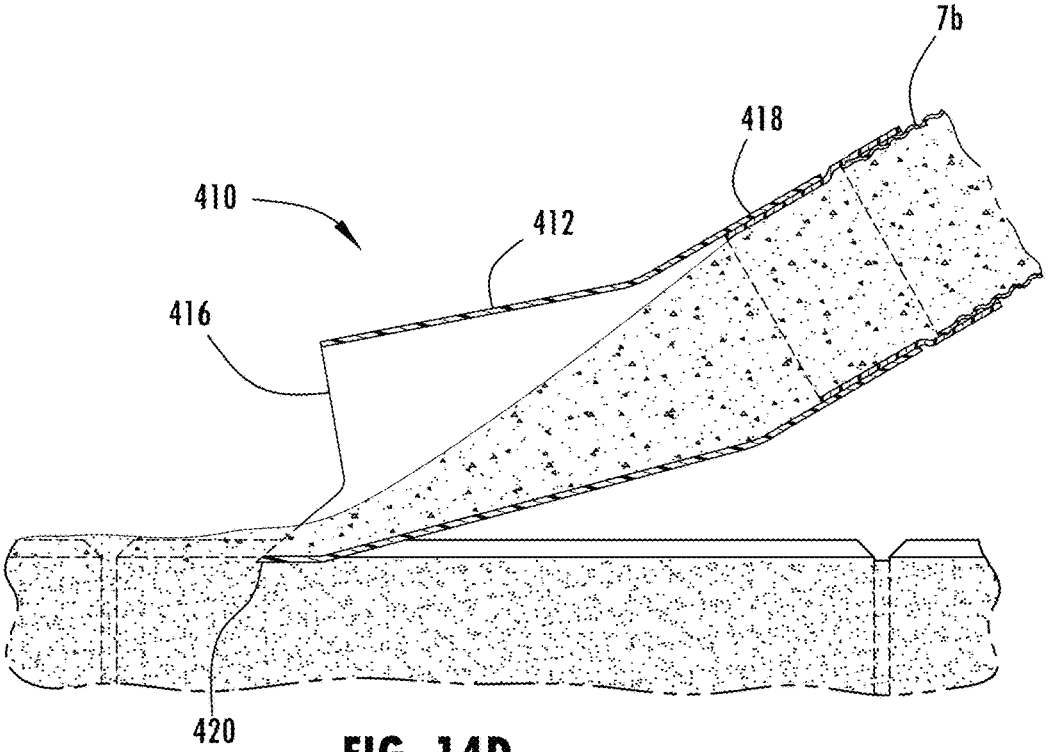
FIG. 14D is a side cross-sectional view of the vacuum attachment tool taken at line XIVD-XIVD shown in FIG. 14C.

Referring now to the example shown in FIGS. 14A-14D, the vacuum attachment tool 410 is similar to the example shown in FIGS. 11A-1D, including but not limited to the body 412 extending between the first opening 414 and the second opening 416 and configured to be coupled to the vacuum hose 7, and the scrapper portion 420 protruding radially outward from the second opening 416 and having a v-shape. However, in the example shown in FIGS. 14A-14D, the second opening 416 is shaped differently such that the scrapper portion 420 extends from the second opening 416 with a longer length than the example shown in FIGS. 11A-11D. Moreover, as shown in FIG. 14D, instead of a tapered shape from a top portion of the second opening 416 to the bottom portion of the second opening 416, as illustrated in the previous figures, the top portion of the second opening 416 extends approximately 90 degrees towards the v-shaped portion of the second opening 416 before jutting out and forming the v-shaped portion. Moreover, as best illustrated in FIG. 14C, the second opening 416 has a more-rounded opening, such that the top portion of the second opening 416 and the v-shaped portion of the second opening 316 are connected in a smooth and rounded shape. Again, various other shapes and sizes are contemplated, including but not limited to a different shape of the intake opening from the examples illustrated herein.

For purposes of this disclosure, the term "coupled" (in all of its forms, couple, coupling, coupled, etc.) generally means the joining of two components directly or indirectly to one another. Such joining may be stationary in nature or movable in nature; may be achieved with the two components and any additional intermediate members being integrally formed as a single unitary body with one another or with the two components; and may be permanent in nature or may be removable or releasable in nature, unless otherwise stated.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional implementations that also incorporate the recited features. Furthermore, the terms "first," "second," and the like, as used herein do not denote any order, quantity, or importance, but rather are used to denote element from another.

Numbers, percentages, ratios, or other values stated herein are intended to include that value, and also other values that are "about" or "approximately" the stated value, as would be appreciated by one of ordinary skill in the art encompassed by implementations of the present disclosure. A stated value should therefore be interpreted broadly enough to encompass values that are at least close enough to the stated value to perform a desired function or achieve a desired result. For example, the terms "approximately," "about," and "substantially" may refer to an amount that is within less than 5% of, within less than 1% of, within less than 0.1% of, and within less than 0.01% of a stated amount.

Further, it should be understood that any directions or reference frames in the preceding description are merely relative directions or movements. For example, the terms "upper," "lower," "right," "left," "rear," "front," "vertical," "horizontal" and derivatives thereof shall relate to the orientation shown in FIG. 1. However, it is to be understood that various alternative orientations may be provided, except where expressly specified to the contrary. It is also to be understood that the specific devices and processes illustrated in the attached drawings, and described in this specification are simply exemplary embodiments of the inventive concepts defined in the appended claims. Hence, specific dimensions and other physical characteristics relating to the embodiments disclosed herein are not to be considered as limiting, unless the claims expressly state otherwise.

Changes and modifications in the specifically described embodiments may be carried out without departing from the principles of the present invention, which is intended to be limited only by the scope of the appended claims as interpreted according to the principles of patent law. The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

What is claimed is:

1. A vacuum attachment tool comprising:

a hollow body;

a nozzle end of the hollow body having an intake opening for receiving air and debris, wherein a portion of a periphery of the intake opening is defined by two planar walls forming a v-shape;

an attachment end of the hollow body configured to be coupled to a vacuum remote from the hollow body that generates an air flow path from the intake opening through the hollow body; and a scrapper portion separate from and disposed at the nozzle end of the hollow body, the scrapper portion having a leading edge defined in a v-shape along the portion of the periphery of the intake opening that is configured to correspond to a chamfered shape of a crevice for scraping debris from the crevice, wherein the v-shape defined by the leading edge of the scrapper portion protrudes radially outward from an interior of the air flow path.

2. The vacuum attachment tool of claim 1, wherein the scrapper portion comprises a metal blade that defines the v-shape of the leading edge.

3. The vacuum attachment tool of claim 1, wherein the scrapper portion comprises a rigid piece that is separate from the hollow body and that is attached at least partially along a distal edge of the nozzle end of the hollow body.

4. The vacuum attachment tool of claim 1, wherein the leading edge of the scrapper portion comprises a first linear edge and a second linear edge of a planar plate that meet at a point and together define the v-shape that forms an angle configured to correspond to a crevice angle of the chamfered shape of the crevice.

5. The vacuum attachment tool of claim 4, wherein the angle of the v-shape defined by the leading edge is between 30 degrees and 90 degrees.

6. A vacuum attachment tool comprising:

a hollow body comprising a nozzle end that has an intake opening and an attachment end for attachment to a vacuum that generates suction of air and debris along an interior suction path from the intake opening through the hollow body, wherein a portion of a periphery of the intake opening is defined by two planar walls forming a v-shape; and a scrapper portion separate from and disposed at the nozzle end of the hollow body, wherein the scrapper portion comprises a leading edge that defines a v-shape along the portion of the periphery of the intake opening so as to protrude radially outward from the interior suction path, and wherein the v-shape of the leading edge is configured to correspond to a chamfered shape of a ground crevice.

7. The vacuum attachment tool of claim 6, wherein the scrapper portion comprises a rigid member that defines the v-shape of the leading edge.

8. The vacuum attachment tool of claim 6, wherein the v-shape of the leading edge protrudes a distance from the nozzle end of the hollow body that is less than a threshold depth of a ground crevice, and wherein the threshold depth is 30 mm.

9. The vacuum attachment tool of claim 6, wherein the scrapper portion comprises a metal member that extends outward in a direction with the interior suction path beyond the hollow body to define the leading edge.

10. The vacuum attachment tool of claim 6, further comprising a tubular wand extension attached to the attachment end of the hollow body and configured to attach to a hose of the vacuum.

11. A vacuum system comprising:

a vacuum appliance;

a vacuum hose attached to the vacuum appliance; and a vacuum attachment tool attached to the vacuum hose, the vacuum attachment tool comprising:

a hollow body having an attachment end coupled to the vacuum hose and a nozzle end with an intake opening for receiving air and debris, wherein a portion of a periphery of the intake opening is defined by two planar walls forming a v-shape, and wherein air flow generated by the vacuum appliance is received from the intake opening through the hollow body along an air flow path therein; and a scrapper portion separate from and disposed at the nozzle end of the hollow body, wherein the scrapper portion includes a leading edge defined along the portion of the periphery of the intake opening in a v-shape that is configured to correspond to a chamfered crevice for scraping debris out of the chamfered crevice, and wherein the v-shape defined by the leading edge of the scrapper portion protrudes radially outward from an interior of the air flow path.

* * * * *